US005138928A

United States Patent [19]

Nakajima et al.

[11] Patent Number: 5,138,928

[45] Date of Patent: Aug. 18, 1992

[54] RHYTHM PATTERN LEARNING APPARATUS

[75] Inventors: Masako Nakajima; Yuji Kijima, both of Yokohama, Japan

[73] Assignee: Fujitsu Limited, Kawasaki, Japan

[21] Appl. No.: 555,764

[22] Filed: Jul. 23, 1990

[30] Foreign Application Priority Data

Jul. 21, 1989 [JP] Japan ..... 1-1875514

[51] Int. Cl.[5] ..... G10H 1/40; G10H 7/00

[52] U.S. Cl. ..... 84/635; 84/667; 84/DIG. 10; 84/DIG. 12

[58] Field of Search ..... 84/609-614, 84/634-638, 650-652, 666-669, 712-717, DIG. 10, DIG. 12

[56] References Cited

U.S. PATENT DOCUMENTS 4,022,097 5/1977 Strangio ..... 84/DIG. 12
4,839,810 6/1989 Abe ..... 84/DIG. 12
4,887,505 12/1989 Suzuki ..... 84/714

*Primary Examiner*—Stanley J. Witkowski

*Attorney, Agent, or Firm*—Staas & Halsey

[57] ABSTRACT

A rhythm pattern generating apparatus is provided having a layered neural network to perform learning with feedback to generate an output pattern signal indicative of a musical sound pattern. The output pattern signal is generated by the layered neural network with feedback in response to a performance operation of a player. The layered neural network generates the output pattern signal indicative of the musical sound pattern based on both an input pattern signal and a weight signal. The output pattern signal is fed back by the feedback circuit to the layered neural network to perform the learning process. A drum pad can be used to provide an input to the rhythm pattern generating apparatus or, specifically, to gate an input pattern selector for selecting input pattern signals. The layered neural network with the feedback can perform the learning process using a back propagation method. In the present invention, when a new rhythm pattern is input by a musician, an output pattern signal is generated through an analogy with the rhythm style of the musician.

25 Claims, 17 Drawing Sheets

RHYTHM PATTERN LEARNING APPARATUS

BACKGROUND OF THE INVENTION

1. Field of the Invention

The present invention relates to a rhythm pattern generating apparatus for generating rhythm pattern information in response to and based on rhythm pattern information formed of a plurality of musical instrument sounds.

2. Description of the Related Art

Recently, artificial intelligence (AI), factory automation (FA) and office automation (OA) have been developed and demand for an intelligent (flexible) system and a sensitive process which can be easily used by humans and is compatible with a human has been increased. In response to this demand, the process of handling an art in which human sensitivity is maintained is performed. However, a "flexible" system is still far from being achieved, and the need to develop the technology for forming a "flexible" system is increasing.

Such a need also exists in the musical world. For example, in playing a drum, a so called "session" is performed. In the session, a drum performance by a player is conducted in parallel with other drum players. In recent years, with progress in development of electronic instruments, the musical instrument performs by itself in parallel with the performance of an electronic musical instrument such as a rhythm instrument performed by one player. If the rhythm pattern can automatically respond to the rhythm pattern generated by the player, it is possible to enable amateurs other than a music professional to greatly increase interest in music, thereby contributing to the development of the music industry. On the other hand, many rhythm pattern generating apparatuses have been realized, in which the rhythm pattern is automatically produced even if the player does not perform anything. Therefore, the player can concentrate on the melody rather than the rhythm, enabling a musical instrument to be played with more variety.

In a conventional rhythm pattern generating apparatus capable of outputting a rhythm pattern in response to the input of the rhythm pattern by the player, a human previously considers the information as to which rhythm pattern is input and it is strictly described in the form of the table which output rhythm pattern is to be generated in response to which rhythm pattern is input. The control program make access to the table for the information of the rhythm pattern obtained from the electronic musical instrument performed by the player and performs the program, thereby generating a rhythm pattern in response to the rhythm pattern.

In another conventional example of the rhythm pattern generating apparatus capable of outputting rhythm pattern in response to the input of the rhythm pattern formed by a player, the relation rule is derived from a pair of discretional input rhythm patterns and the output rhythm pattern is recited by a program. The information of the rhythm pattern performed by a player is converted in accordance with the above relation rule, thereby producing the rhythm pattern in response to the rhythm pattern.

On the other hand, another conventional prior art rhythm pattern generating apparatus produces a rhythm pattern automatically. The data of the rhythm pattern is previously stored by the player in the memory and is read out with fidelity, and thereby the rhythm pattern is automatically generated.

However, in one of the conventional examples using table type of the rhythm pattern outputting the rhythm pattern in response to an input of the rhythm pattern by a player, an apparatus using a table is provided. In this type, all the combinations of the input rhythm patterns and the output rhythm pattern which should be considered they should be described strictly in the form of the table. Therefore, in the above conventional example, where the rhythm pattern described at the table is input, the apparatus can reply to the input rhythm pattern correctly, but where an irregular rhythm pattern other than the rhythm pattern recited in the table is input. Thus, the conventional example cannot respond to an irregular input rhythm pattern.

In the conventional example in which the relation rule is programmed, it is very difficult to obtain the relation rule from the pair of a discretional input rhythm pattern and an output rhythm pattern and the relation rule has to be corrected and changed whenever the player is changed.

Further, in these two conventional examples, in order to provide data of a predetermined time period with regard to information as to whether the rhythm sound "is produced or not produced" the data of (the number of kinds of rhythm sound)×(time period) is necessary, thereby enabling the data amount to be extremely large and making a real time process difficult. In particular, in order to make a real musical expression possible, the velocity representing the strength of the rhythm sound is needed to be provided in the form of data. In the prior art in which a great amount of data is required, it was almost impossible to deal with the velocity of the sound in the form of data.

On the other hand, in the conventional example of the rhythm pattern automatic generating apparatus for automatically producing a rhythm pattern, the rhythm pattern previously prepared by the player is merely produced with a good fidelity. Therefore, a prior art automatic rhythm pattern generating apparatus can perform a rhythm pattern efficiently or repeatedly with this case. But when the player wants to change the rhythm pattern to some extent, all the variation patterns are provided and must be previously stored in the memory as data.

SUMMARY OF THE INVENTION

An important object of the present invention is to generate an output rhythm pattern as required by the player in response to the input rhythm pattern through a simple learning process and to automatically produce a rhythm pattern train reflecting the intention of the player as well as the previously prepared rhythm pattern train.

The first mode of the present invention has a structure of an associating of an input pattern with an output pattern through a previous learning so that the output pattern required by the player is produced in response to the input pattern more than one input information representing the state of the production of the musical sound is input as an input pattern at respective performance timings, and the output pattern corresponding to the input pattern is output as more than one output pattern information representing the state of the production of the musical sound. With this structure, the player need not perform strict programming by considering the pair of all the input pattern and the output pattern responsive thereto. The human player has to only provide the input and output pattern association unit with the basic input and output pattern pair. After completion of the learning process, even if input information having a value other than the basic value used for the learning is input, output information having a value other than the basic value corresponding to the input information in good manner can be output and the session of the drum sound, for example, can be realized with a reality by only one player.

The second mode of the present invention has an input calculating data generating unit for generating the input calculation data by compressing more than one input performance information representing the state of production of the musical sound at respective performance timings.

It also has an input and output pattern association unit similar to the first mode in which the input pattern is the input calculation data and the output pattern is the output calculation data.

Further, it has an output performance information generating unit for generating more than one output performance information representing the state of the production of the musical sound from the output calculation information output from the input and output pattern association unit for respective performance timings.

With the above structure, the input performance information representing the on/off or velocity, for example, of many kinds of musical instrument sounds based on the performance operation can be compressed with effectivity and can be input into the input and output pattern association unit, thereby enabling the real time process to be performed. As the output pattern of the compress in state can be reproduced as the output data representing on/off or velocity, for example, of the kinds of musical instrument sounds, thereby providing realistic output performance data in response to the performance operation.

The first or second mode of input and output pattern association unit has a plurality of units connected with a discretional weight and the input and output pattern associating unit comprises an input layer comprising a plurality of units for inputting the respective information forming the input pattern, an output layer comprises a plurality of units for outputting respective information for forming the output pattern, and more than one hidden layer connected between the input layer and the output layer and comprises a plurality of units. Thus, the input and output pattern association unit adjusts the association of the input pattern and the output pattern by adjusting the weight between units forming a layer network by using a back propagation algorithm so that, when the input pattern is input to the input layer, the player can output the desired output from the output layer in response to the input pattern. The process of using the layered network is suitable for the computer with the parallel process architecture. The production of the output pattern at a real time in response to the receipt of the input pattern can be easily realized, thereby contributing to a flexible real time control of the music, for example.

The third mode of the present invention has the same input and output association unit as in the first mode. It has a start information supply unit for supplying the start pattern to the input and output pattern association unit as the start information. It also has a feedback unit for feeding back the output information to the input side of the input and output pattern association unit as the input information with a modification or without a modification.

With the above structure, the input and output pattern association unit is utilized and the output information is fed back to the input side of the input and output pattern association unit by the feedback unit, thereby automatically producing the output pattern train. At this time, the output information can be modified by the feedback unit and thus the intention of the player can be well reflected on automatic generation operation of the output pattern train.

BRIEF DESCRIPTION OF THE DRAWINGS

The other objects and features of the present invention can be easily understood by a person skilled in the art based on the description of the preferred embodiment, together with the attached drawings.

DESCRIPTION OF THE PREFERRED EMBODIMENTS

An Explanation of the Principle

Figure 1A:
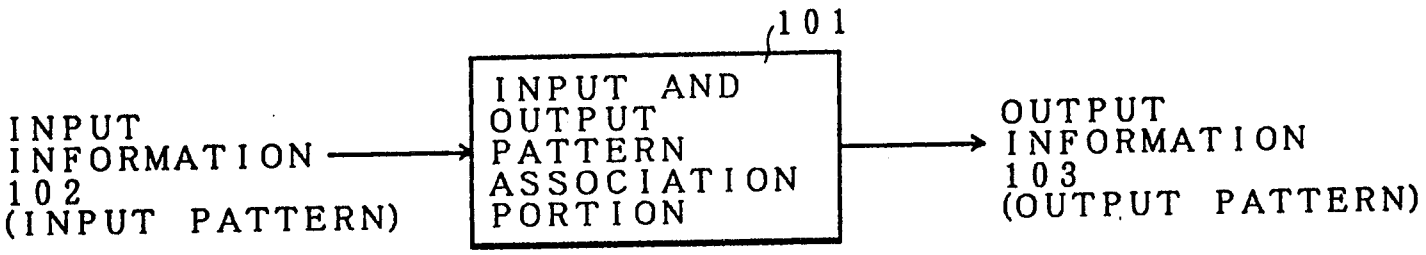
FIG. 1A is a principle block diagram of a first mode of the present invention.

FIG. 1A shows a principle block diagram of the first mode of the present invention.

The first mode includes the input and output pattern association unit 101 described below. The input and output pattern association unit forms an association of the input pattern and output pattern through a previous learning so that the output pattern desired by the player can be generated in response to the input pattern. The association unit 101 receives more than one block of input information 102 representing the state of the generation of the musical sound and outputs the output pattern responsive to the input pattern as more than one block of output information 103 representing the state of generation of the musical sound.

In the structure shown in FIG. 1A, the input pattern comprising more than one block of information 102 representing the state of production of the musical sound paired with the output pattern replying to more than one block of output information 103 in response to the input pattern is learned through learning and training of the network of the basic pattern combination associated with the input and output pattern association unit 101 formed by the network. Therefore, a player need not prepare a strict program by considering the pairs comprising all the input patterns. A human has only one basic pair of input and output patterns to input and output pattern association unit 101. After completion of the learning process, even if input information 102 having a value other than the basic value used for the learning is input, output information 103 having a value other than the basic value which is well responsive to the input information 102 can be outputted.

Figure 1B:
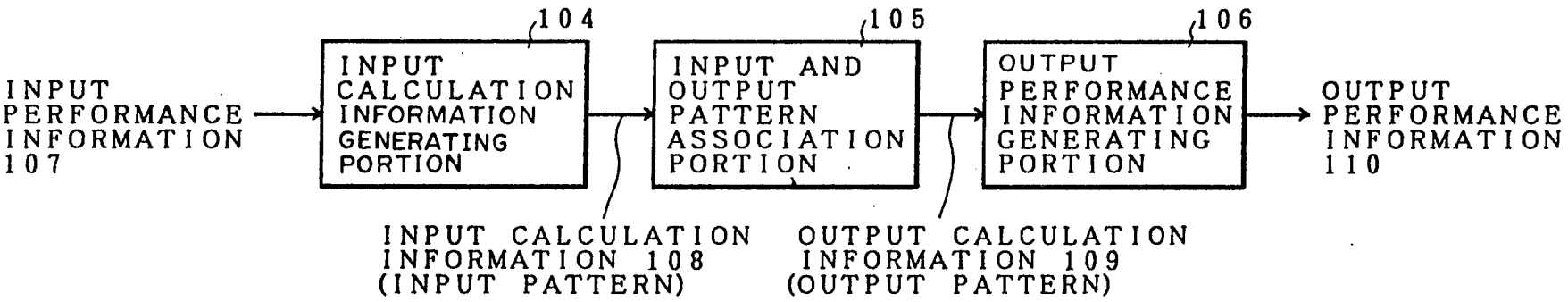
FIG. 1B is a principle block diagram of a second mode of the present invention.

The present invention includes the second mode shown by the principle block diagram of FIG. 1B as an extension of the first mode.

In FIG. 1B, input calculation information generating unit 104 generates input calculation information 108 by complexing more than one block of input performance information 107 representing the state of generation of the musical sound at respective performance timings. The input calculation information generating unit 104 generates, at respective performance timings, more than one block of input performance information 102 representing the production period of the sound, the silent period of the musical sound and the velocity of the musical sound in accordance with predetermined rules for a plurality of kinds of predetermined musical sound, and the multi-value data represented by respective real number value is produced as input calculation information 108.

Input and output pattern association unit 105 is the same as the corresponding unit 101 in FIG. 1A except that the input pattern is input calculation information 108 and output pattern is the output calculation information 109. In this case, the output calculation information 109 output from input and output pattern association unit 105 for respective performance timings is the multi-valued data represented by at least one real number value.

Output performance information generating unit 106 generates more than one output performance information 110 representing the sound production state of the musical sound from output calculation information 109 outputted from the input and output pattern association unit 105 at respective performance timings. The output performance information generating unit 106 converts the multi-valued data represented by a real value of respective output calculating information 109 at respective performance timings in accordance with the predetermined rule and produces more than one block of output performance information 110 representing the musical sound being produced, the musical sound being silent, and further the velocity of the musical sound.

In the second mode, input performance information 107 and output performance information 110 is MIDI (musical instrument digital interface) signal, for example. The above more than one input performance information 107 is a block of input rhythm pattern information from more than one drum pad. In this case, the input start and stop of input calculation information 108 to input and output pattern association unit 105 and the switch control unit performed by one of the above drum pads may be further included in the second mode structure.

According to the structure shown in FIG. 1B, input and calculation information generating unit 104 effectively compresses input performance information 107 representing the on/off or the velocity of a plurality of musical sounds based on the performance operation, thereby outputting it as input calculation information 108. Input and output pattern association unit 105 receives input calculation information 108 of the compressed state and produces output calculation information 109 of the compressed state. The output calculation information 109 is converted to output performance information 110 representing on/off or velocity, for example, of many kinds of musical instrument sounds in output performance information generating unit 106 is outputted, and more particularly is produced, as a sound from the sound source unit (not shown). As recited above, input and output pattern association unit 105 performs a process with the compressed data, which enables a real time process and provides output performance information 110 which responds to the performance operation in a real manner.

In this case, the pattern input to and output from input and output pattern association unit 105 comprises a rhythm pattern corresponding to a drum sound. However, it is not limited to this pattern and various other patterns such as an accompanied pattern or melody pattern may be input and output.

Input performance information 107 is produced from a drum pad or a MIDI performed by a player and then the input pattern is produced effectively manner. If the start and stop of the operation of the present whole system can be controlled by one of the drum pad, the instruction of the start and stop of the operation can be performed without disturbing the performance operation.

In the first and second mode shown in FIGS. 1A and 1B, the input and output pattern association units 101 or 105 have respective units connected by a discretional weight, and comprises an input layer comprising a plurality of units to which respective blocks of information 102 or 108 forming the input pattern are input, an output layer comprising a plurality of units for outputting respective blocks of information 103 or 109 forming the output pattern, and more than one hidden layer connected between the input layer and the output layer, each comprising a plurality of units. Input and output pattern association units 101 and 105 form an association of the input pattern and output pattern by arranging the weight between units forming a layered network so that the output pattern desired by the player is output from the output layer in response to the input pattern when the input pattern is input to the input layer. More particularly, the input and output pattern association units 101 and 105 adjust the weight between units forming the layered network by a back propagation algorithm when the learning input pattern and output pattern pair is provided to the layered network. Therefore, in addition to the structure shown in FIGS. 1A and 1B, input and output pattern association unit 101 or 105 may comprise a mode switching unit for performing a switching between a learning mode and a rhythm pattern output mode and a learning input and output pattern pair supplying unit for supplying the pair comprising an input pattern and an output pattern for learning to the input and output pattern association unit when input and output pattern association units 101 or 105 are in the learning mode. In such a layered network structure, the learning is performed by a back propagation algorithm, and an effective and stable learning process becomes possible. A layered network can be formed on the parallel computer, thereby enabling a real time process.

Figure 1C:
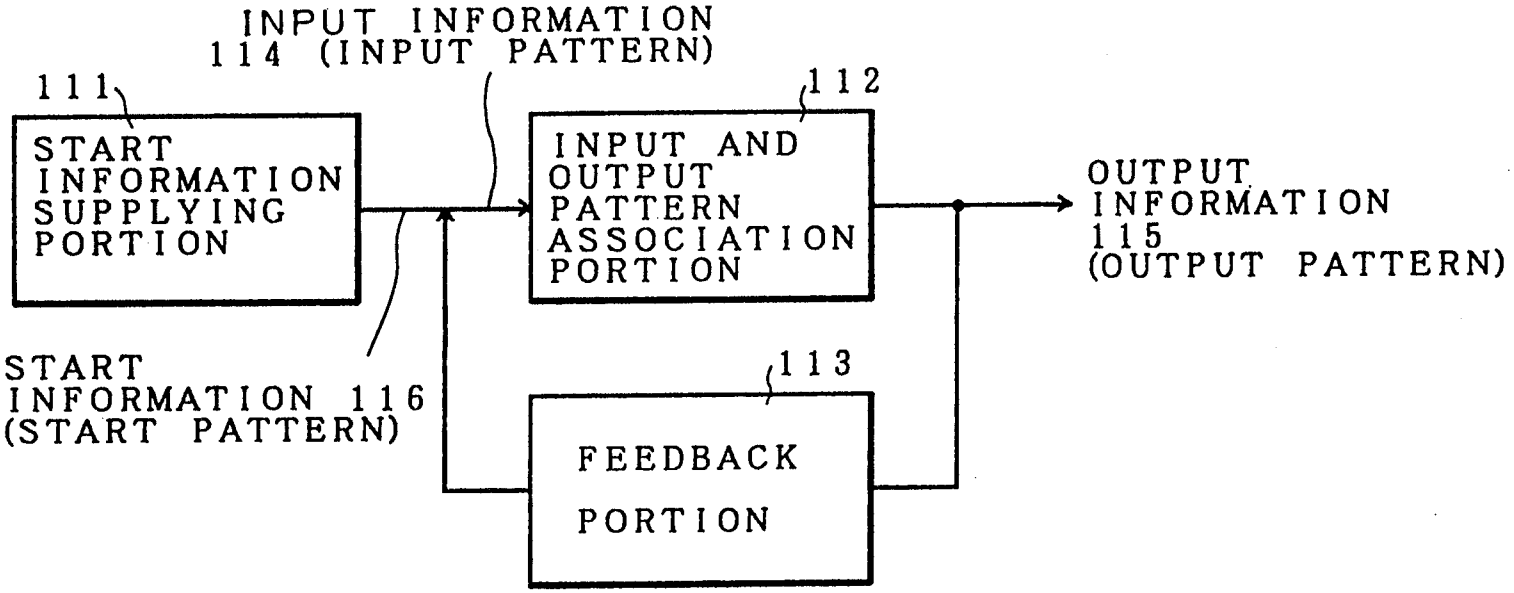
FIG. 1C is a principle block diagram of a third mode of the present invention.

FIG. 1C shows a principle block diagram of the third mode of the present invention.

In this mode, the following start information supplying unit 111 and feedback unit 113 are provided in addition to the input and output pattern association unit 112 in a similar manner to the input and output pattern association unit 101 in the first mode (FIG. 1A) using input information 114 as the input pattern and the output information 115 as the output pattern.

Namely, a start information supplying unit 111 supplies the start pattern to the input and output pattern association unit 112 as start information 116. Start information supplying unit 111 includes start information selection unit comprising a start information storing unit for storing a plurality of start information, for example, and the start information selection control unit for enabling a player to select the start information within the start information storing unit. Start information supplying unit 111 includes the start information generating unit for generating the start information based on the performance operation by a player. Further, start information supplying unit 111 includes a start information selection unit and a start information generating unit and includes a start information input target selection unit for enabling a player to select either of them.

Feeding back output information 115 to the input side of the input and output pattern association unit 112 and input information 114 with modification or without modification is provided The input and output pattern association unit 112 includes an arithmetic operating unit for performing an operation of the output information, for example. In addition, it includes an arithmetic operation information storing unit for storing arithmetic information for controlling the operation units, and a selection unit for selecting the arithmetic operation information stored in the arithmetic operation information storing unit. The selection unit in this case, further inputs the performance information representing the performance operation by the player and controls the arithmetic operation units based on the performance information.

According to the structure shown in FIG. 1C, the appropriate output pattern is produced in response to the input pattern. The same input and output pattern association unit 112 as input and output pattern association unit 101 in the first mode (FIG. 1A) is utilized and output information 115 is fed back to the input side of the input and output pattern association unit as the input information 114 through the feedback unit 113, thereby automatically producing the output pattern train.

At this time, the output information 115 may be modified (or may not be modified) by feedback unit 113, thereby well reflecting the intention of the player when the above output pattern train is automatically produced.

For, example, by reading the arithmetic operation information from the selection unit of the arithmetic operation information storing unit provided within feedback unit 113 and in the operation unit, the output information 115 is modified so that the output pattern becomes "fill-in" "ending" and "fade out". If the selection unit inputs the performance information designating the performance operation by a player, for example and the arithmetic operation unit is controlled based on the performance information, the output pattern can be automatically produced along a pleasant flow of performance so that in the same manner as the player teaches the performance information.

The player can discretionally select or produce start information 116 designating the start pattern which becomes a trigger upon automatically forming the output pattern by using start information supplying unit 111, thereby automatically producing the output pattern train which varies in various ways.

Input and output pattern association unit 112 in the third mode can be formed by a layered network in the same manner as in the first or second mode, but is not limited to those modes. The input and output pattern association unit 112 may be formed as follows. It can output output information 115 designating the output pattern appropriately responding to input information 114 designating the input pattern.

A first preferred Embodiment

Figure 2:
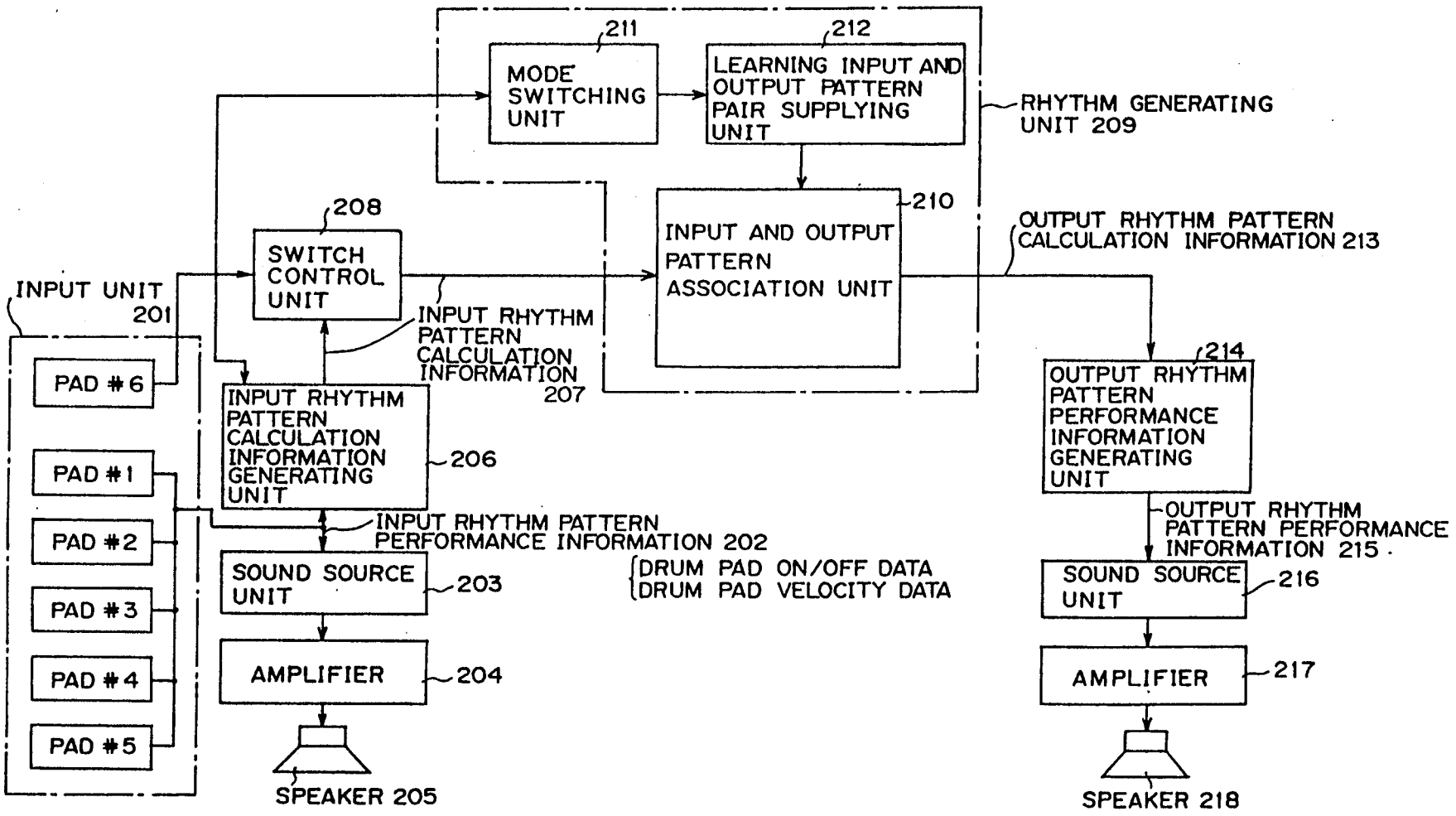
FIG. 2 is a block diagram of the first preferred embodiment of the present invention.

FIG. 2 shows a structure of a first preferred embodiment.

Input unit 201 is formed of a plurality of drum pads #1 to #6 performed by the player. Respective drum pads can output in parallel. The input rhythm pattern performance information 202 corresponds to MIDI (Musical Instrument Digital Interface) standard. This information comprises a note-on data (a velocity data representing a strength of the drum pad) produced by striking the drum pad or a note-off data automatically transmitted after the note-on data transmitted. Respective drum pads #1 to #5 correspond to five kinds of drums such as bass drum, snare, low-tom, high-tom and high-hat in the drum set. The drum pad #6 is a pad for controlling switch control unit 208 and will be described later.

Input pattern performance information 202 is input to sound source unit 203. Sound source unit 203 produces a drum sound corresponding to the input performance information among the drum sounds of five kinds of drums. The drum sound is amplified by amplifier 204 and is produced from speaker 205.

Input rhythm pattern performance information 202 is input to input rhythm pattern calculation information generating unit 206. The input rhythm pattern calculation information generating unit 206 converts a performance information 202 to input rhythm pattern calculation information 207. Calculation information 207 is input to switch control unit 208.

Switch control unit 208 detects that a player strikes a drum pad of #6 of input unit 201 and starts to output input rhythm pattern calculation information unit 207 to rhythm generating unit 209. Next, it detects that the drum pad of #6 of input unit 201 is struck by a player, thereby stopping the above output operation.

Input and output pattern association unit 210 of rhythm generating unit 209 outputs the corresponding output rhythm pattern calculation information unit 213 to input rhythm pattern calculation information 207.

Output rhythm pattern performance information generating unit 214 converts the output rhythm pattern calculation information unit 213 to the output rhythm pattern performance information 215 corresponding to the MIDI standard.

Sound source unit 216 receives the performance information 215 and produces a corresponding drum sound. The drum sound is amplified by amplifier 217 and produced from speaker 218. Input and output pattern association unit 210 in rhythm generating unit 209 forms a neural network. This neural network performs a learning by using the learning input and output pattern obtained from learning input and output pattern pair supplying unit 212 and one appropriate pair of blocks of output rhythm pattern calculation information 213 is outputted for a pair of blocks of input rhythm pattern calculation information 207 after the learning is completed. The input rhythm pattern calculation information 207 is produced from the input rhythm pattern performance information 202 which becomes a source of a drum sound produced by sound source unit 203 and output rhythm pattern calculation information 213 produces output rhythm pattern performance information 215 forming the source of the drum sound to be produced from sound source unit 216.

Therefore, in response to the production of the drum sound from speaker 205 in accordance with the performance operation of drum pads #1 to #5 by the player, a drum sound harmonized with the drum sound is produced from speaker 218. Therefore, a so-called "drum session" can be realized. When the input and output pattern association unit 210 performs a learning, mode switching unit 211 prohibits the output input rhythm pattern calculation information generating unit 206 from outputting input rhythm pattern calculation information 207, thereby allowing the learning input and output pattern to be outputted to the learning input and output pattern pair supplying unit 212. The learning input and output pattern is thereby, input to input and output pattern association unit 210 instead of the input rhythm pattern calculation information 207.

As described above, in the present embodiment, input and output pattern association unit 210 forming a neural network performs a learning by using a learning input and output pattern from learning input and output pattern pair supplying unit 212 and outputs an appropriate pair of output rhythm pattern calculation information 213 in response to a pair of input rhythm pattern calculation information 207. The formation of the neural network and the learning method for this case will explained hereinafter.

The embodiment utilizes a layered network with a learning function called back propagation as a neural network. (D. E. RUMELHAR T, G. E. HINTON, and R. J. WILLIAMS, "Learning Internal Representations by Error Propagation" PARALLEL DISTRIBUTED PROCESSING, Vol. 1, pp.318-364, the MIT press, 1986).

The layered network comprises a plurality of nodes called basic units and a structure comprising input layer $S_I$, hidden layer $S_M$ and output layer $S_O$. The respective basic unit in output layer $S_O$ receives a value from the basic unit in hidden layer $S_M$ through a weighting process. The basic unit of output layer $S_O$ outputs the respective output rhythm pattern calculation information 213. The respective basic unit in hidden layer $S_M$ receives values from the input layer $S_I$ through a weighting process. Further, the all basic unit of input layer $S_I$ receives respective input rhythm pattern calculation information 207.

As described, the respective basic unit is formed in a system with a multiple input and a single output. In a basic unit in a layer, the respective outputs of all the units in the layer of the input side are multiplied by the corresponding weight and the products are added. The sum is subjected to a predetermined threshold value process and the resulting output is obtained from the basic unit. Namely, the data process in a basic unit comprises a sum-of-products arithmetic process and a threshold process.

The above operation performed in the L-th basic unit in output layer $S_O$ is expressed by the following equations.

$$X_{PL} = \sum_K Y_{PK} \cdot W_{LK} \tag{1}$$

$$Y_{PL} = 1/(1 + \exp(-X_{PL} + \theta_L)) \tag{2}$$

where,

L: a unit number in a unit of output layer $S_O$

K: a unit number in a unit of hidden layer $S_M$, p: an input pattern number $\theta_L$: a threshold value of an L-th unit of output layer $S_O$, $W_{LK}$: a weight of an internal connection between a K-th unit in an hidden layer $S_M$ and an L-th unit in an output layer $S_O$, $X_{PL}$: a sum of products of input from respective units in the hidden layer $S_M$ to an L-th unit in the output layer $S_O$ with regard to P-th input pattern $Y_{PK}$: an output of a K-th unit in the hidden layer $S_M$ with regard to a p-th input pattern $Y_{PL}$: an output of an L-th unit in an output layer $S_O$ with regard to a p-th input pattern Equation (1) represents a sum-of-products an arithmetic operation process and Equation (2) represents a threshold value process. The threshold process has a format for converting an input $(-X_{PL}+\theta_L)$ to be converted by using a sigmoid function. It is a matter of course that any non-linear function other than a sigmoid function can be used.

Similarly, an arithmetic operation conducted at a K-th basic unit in the hidden layer $S_M$ is expressed by the following equations.

$$X_{PK} = \sum_J Y_{PJ} \cdot W_{KJ} \tag{3}$$

$$Y_{PK} = 1/(1 + \exp(-X_{PK} + \theta_K)) \tag{4}$$

where,

J: a unit number of one unit in input layer $S_I$ p: an input pattern number $\theta_K$: a threshold value of a K-th unit in input layer $S_I$ $W_{KJ}$: a weight of an internal connection between a J-th unit in the input layer $S_I$ and a K-th unit in the hidden layer $S_M$ $X_{PK}$: a sum of the products of an input from a unit in the input layer $S_I$ to a K-th unit in the hidden layer $S_M$ with regard to a p-th input pattern $Y_{PJ}$: an output of a J-th unit of the input layer $S_I$ with regard to a p-th input pattern Further, a j-th basic unit in the input layer $S_I$ outputs the value of a J-th input rhythm pattern calculation information 207 in a p-th input pattern as output $Y_{PJ}$ of a J-th unit of input layer $S_I$ for the p-th input pattern. The value of input rhythm pattern calculation information 207 may output the value obtained by converting the value of input rhythm pattern calculating information 207 by using the same sigmoid function as shown in Equation (2).

Figure 3:
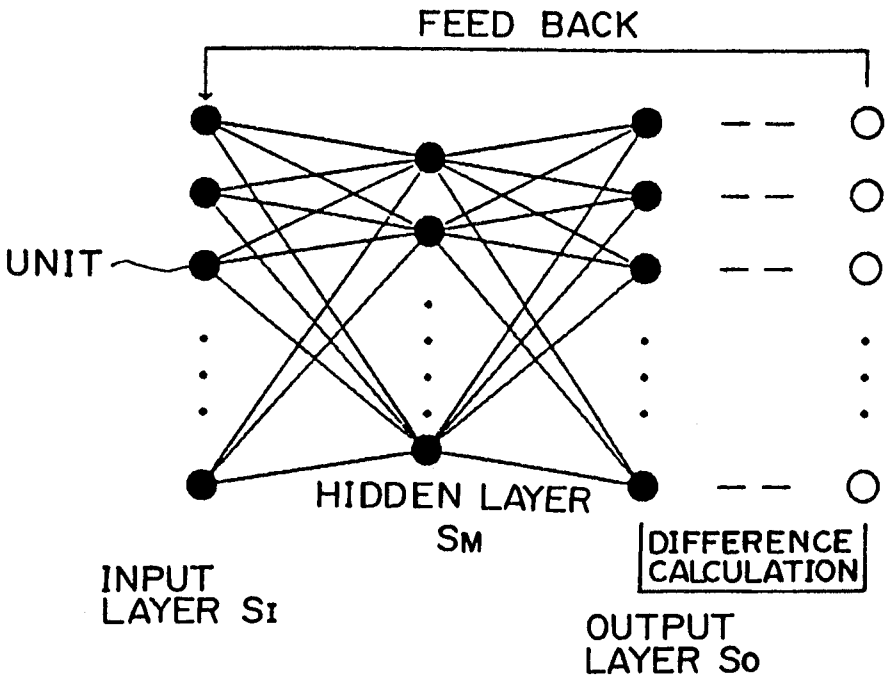
FIG. 3 shows an example of a layered network.

The neural network shown in FIG. 3 in which the above relationship is established is formed in input and output pattern association unit 210 when input and output pattern association unit 210 updates the weight coefficient $W_{LK}$ of an internal connection between hidden layer $S_M$ and an output layer $S_O$ and a weight coefficient $W_{KJ}$ of an internal connection between input layer $S_I$ and the hidden layer $S_M$ through a learning process so that, when respective values of input rhythm pattern calculation information 207 are provided to respective units in input layer $S_I$ as a pair of input patterns, respective values of output rhythm pattern calculation information 213 can be obtained as an appropriate pair of output patterns from respective units of the output layer $S_O$.

In a learning process executed by the input and output pattern association unit 210, a learning algorithm which is called back propagation and is proposed by RUMELHART is used. In accordance with the back propagation algorithm, input and output pattern association unit 210 adaptively and automatically controls weight coefficient $W_{LK}$ and $W_{KJ}$ of the internal connection so that the input pattern for learning a read from a learning input and output pattern pair supplying unit 212 of FIG. 2 is provided to input layer $S_I$ to produce an output pattern from output layer $S_O$ and this may be equaled to an output pattern (learning output pattern) desired and read from said supplying unit 212. Therefore, as shown in FIG. 3, conceptionally, in output layer $S_O$, the difference between the present output pattern and the learning output pattern which is obtained in response to the learning input pattern is calculated and the difference is fed back from output layer $S_O$ to $S_I$ through hidden layer $S_M$.

The back propagation algorithm executed by input and output pattern association unit 210 as the learning process will be explained by referring to an operational flowchart shown in FIG. 4.

The p-th learning output pattern to be output from the L-th unit of output layer $S_O$ designates $\tilde{Y}_{PL}$ and the output value actually obtained from the L-th unit in output layer $S_O$ by inputting the p-th learning input pattern to the neural network shown in FIG. 3 is designated as $Y_{PL}$. By using a Euclid norm, the error $E_{PL}$ of the output value in the L-th unit in output layer $S_O$ with regard to the p-th pattern is evaluated from the following equation.

$$E_{pL}=(\tfrac{1}{2})(\tilde{Y}_{pL}-Y_{pL})^2 \tag{5}$$

Noting weight $W_{LK}$ corresponding to the K-th unit in hidden layer $S_M$ in the L-th unit of output layer $S_O$ with regard to the p-th pattern is noted. In order to minimize $E_{PL}$ with regard to $W_{LK}$, $\partial EPL/\partial WLK$ ($E_{PL}$ partial differential for $W_{Lk}$) is calculated and $W_{LK}$ is updated by the following equation. The following process corresponding to S1 to S4 are shown in FIG. 4.

$$\Delta W_{Lk}(t)=\alpha(-\partial E_{pL}/\partial W_{LK})+\beta\cdot\Delta W_{Lk}(t-1) \tag{6}$$

$$W_{Lk}(t)=W_{Lk}(t-1)+\Delta W_{Lk}(t) \tag{7}$$

where, $\alpha$ and $\beta$ are constant. The second term of the right side of equation (6) is for accelerating the conversion. The reason why the negative sign is put in the term within parenthesis in the first term of the right side is for convenience of calculation and can be considered as being included in constant $\alpha$. t−1 means a value before updating and t means a value after updating. In order to calculate the equations (6) and (7), $-\partial E_{PL}/\partial W_{LK}$ of a slope vector for correcting a weight can be calculated and is obtained as follows.

$$-\frac{\partial E_{PL}}{\partial W_{LK}}=-\frac{\partial E_{PL}}{\partial X_{PL}}\cdot\frac{\partial X_{PL}}{\partial W_{LK}} \tag{8}$$

$$-\frac{\partial E_{PL}}{\partial X_{PL}}=-\frac{\partial E_{PL}}{\partial Y_{PL}}\cdot\frac{\partial Y_{PL}}{\partial X_{PL}} \tag{9}$$

$-\partial E_{PL}/\partial W_{LK}$ reformed to the first term of the right side of the equation (8) is reformed to (9). The first term of the right side of the equation (9) can be obtained by forming a partial differentiation of equation (5).

$$-\frac{\partial E_{PL}}{\partial Y_{PL}}=(\tilde{Y}_{PL}-Y_{PL}) \tag{10}$$

The second term of the right side of the equation (9) can be obtained by performing the partial differentiation of the equation (2) as follows.

$$\frac{\partial Y_{PL}}{\partial X_{PL}}=Y_{PL}(1-Y_{PL}) \tag{11}$$

The first term of the right side of the equation (8) can be obtained from the equation (1) as follows.

$$\frac{\partial X_{PL}}{\partial W_{LK}}=\frac{\partial}{\partial W_{LK}}\cdot\left(\sum_K Y_{PK}\cdot W_{LK}\right)=Y_{PK} \tag{12}$$

Figure 4:
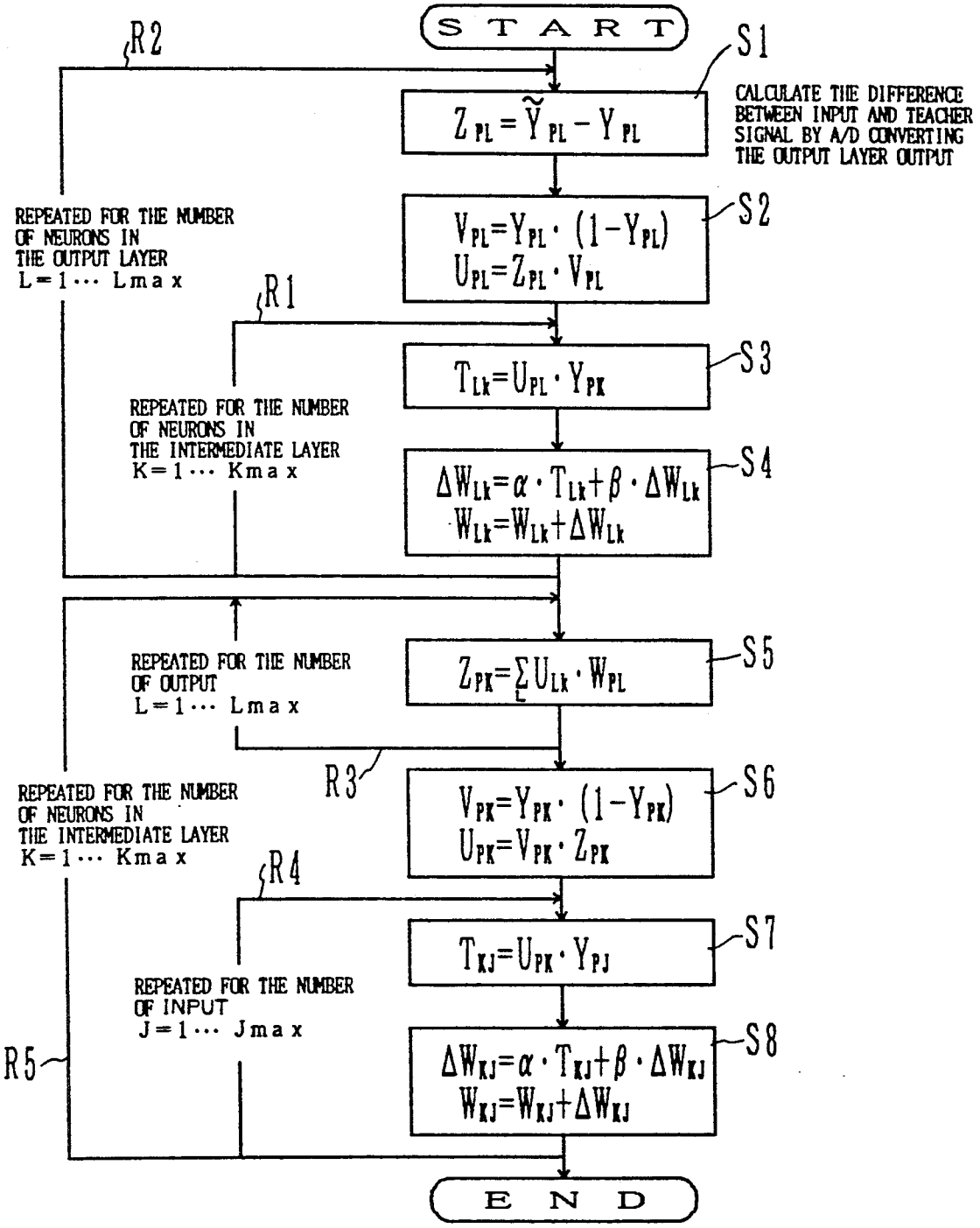
FIG. 4 shows an operational flowchart of a learning algorithm.

Based on the above relation, in S1 of FIG. 4, the value $Z_{PL}$ obtained by the calculating equation (10) is obtained as the difference between the value $\tilde{Y}_{PL}$ of the p th learning output pattern to be output from L-th unit in output layer $S_O$ and the output value $Y_{PL}$ actually obtained from L-th unit in output layer $S_O$ by inputting p-th learning input pattern to a neural network of a structure shown in FIG. 3. In S2 in FIG. 4, the value $V_{PL}$ obtained by performing the calculation of the equation (11) is obtained from the actual output value $Y_{PL}$. At S2 in FIG. 4, the value $U_{PL}$ obtained by the calculation equation (9) is provided as a product of $Z_{PL}$ and $V_{PL}$ obtained as described above. Therefore, the first item of the right side of the equation (8) is obtained. On the other hand, the second term of the right side of the equation (8) is equal to the output value $Y_{PK}$ actually obtained from K-th unit in hidden layer $S_M$ by inputting the p-th learning input pattern to a neural network structure shown in FIG. 3. Accordingly, in S3 in FIG. 4, the value $T_{LK}$ the obtained by the calculation of equation (8) is obtained as a product of the value $U_{PL}$ obtained in S2 in FIG. 4 and the above $Y_{PK}$. The value $T_{LK}$ is slope vector $-\partial E_{PL}/\partial W_{LK}$ for correcting a weight using the equation (6). By entering the value $T_{LK}$ to the equations (6) and (7) following equation shown in S4 in FIG. 4 is obtained.

$$\Delta W_{Lk}=\alpha T_{LK}+\beta\cdot\Delta W_{Lk} \tag{13}$$

$$W_{Lk}=W_{Lk}+\Delta W_{Lk} \tag{14}$$

Therefore, weight $W_{LK}$ for K-th unit in hidden layer $S_M$ in L-th unit in output layer $S_O$ with regard to the p-th pattern can be updated. t−1 and t shown in the equations (6) and (7) are abbreviated.

The process in S3 and S4 in FIG. 4 are repeated as shown by R1 in FIG. 4 by changing the value of the subscript K from 1 to $K_{max}$. and when the weight $W_{L1}$ to $WL_{max}$. corresponding to all the units of $K_{max}$. number in hidden layer $S_M$ in L-th unit in output layer $S_O$ with regard to this pattern are updated.

When this repeating process is completed, the back propagation of the error from L-th unit in output layer $S_O$ in FIG. 3 to the hidden layer $S_M$ with regard to this pattern is completed. Further, the processes S1 to S4 including a repetition designated by R1 in FIG. 4 is repeated as shown by R2 in FIG. 4 by changing the value of subscript L from 1 to $L_{max}$. and the weight corresponding to all the units of $K_{max}$. number in hidden layer $S_M$ in all the units of $L_{max}$. number in output layer $S_O$ with regard to p-th pattern is updated.

When the above repetition process is completed, feeding back operation of the error to hidden layer $S_M$ in all the units in output layer $S_O$ in FIG. 3 with regard to p-th pattern is completed. Then, next, the feeding back operation of the error to input layer $S_I$ in respective units in hidden layers $_M$ in FIG. 3 with regard to this pattern is performed.

This process is designated as processes S5 to S8 in FIG. 4 and a repeating process of R3, R4 and R5. This process is almost similar to the process in S1 to S4 in FIG. 4 for output layer $S_O$ and the repeating process of R1 and R2 and can be understood as a process obtained by replacing subscript K by J and L by K, respectively.

However, the above process is different only in respect of the process in S5 for S1 and a repetition process shown by R3. Namely, in S1, the value $Z_{PL}$ corresponding to the equation (10) is obtained by performing a partial differentiation of error $E_{PL}$ of the output value in L-th unit in the output layer $S_O$ for the p-th pattern by using the output value $Y_{PL}$ actually obtained from L-th unit in output layer $S_O$ by inputting p-th learning input pattern to the neural network of the structure shown in FIG. 3.

Error $E_{PL}$ is obtained based on the difference between the value $\bar{Y}_{PL}$ of the p-th learning output pattern to be outputted from L-th unit in output layer $S_O$ and the output value $Y_{PL}$ actually obtained from L-th unit in the output layer $S_O$ by inputting the p-th learning input pattern to a neural network of a structure shown in FIG. 3. In accordance with this operation, in S5, the value $Z_{PK}$ corresponding to the equation (10) is obtained by performing a partial differentiation of error $E_{PK}$ of the output value in K-th unit in hidden layer $S_M$ with regard to p-th pattern by the output value $Y_{PK}$ actually obtained by K-th unit in hidden layer $S_M$ by inputting the p-th learning input pattern to a neural network of a structure shown in FIG. 3. However, in the hidden layer $S_M$, the learning value does not exist and thus the value of error $E_{PK}$ is different from the equation (5) and can be obtained a total sum of the error fed back to all the units in the output layer $S_O$ which are connected to K-th unit in hidden layer $S_M$.

Namely, the following equation is established.

$$E_{PK} = \sum_L E_{PL} \tag{15}$$

The $Z_{PK}$ is obtained by partially differentiating $E_{PK}$ by $Y_{PK}$.

$$\begin{aligned} Z_{PK} &= -\frac{\partial E_{PK}}{\partial Y_{PK}} = -\frac{\partial}{\partial Y_{PK}}\left(\sum_L E_{PL}\right) \\ &= -\sum_L \frac{\partial E_{PL}}{\partial Y_{PK}} \\ &= \sum_L \left(-\frac{\partial E_{PL}}{\partial X_{PL}}\right) \cdot \frac{\partial X_{PL}}{\partial Y_{PK}} \end{aligned} \tag{16}$$

The first term of the right side of the equation obtained from equation (9) to (11) and the step S2 in FIG. 4 as follows.

$$-\frac{\partial E_{PL}}{\partial X_{PL}} = U_{PL} \tag{17}$$

The second term of the right side of the equation (16) is obtained by partially differentiating equation (1) by $Y_{PK}$ as follows.

$$\frac{\partial X_{PL}}{\partial Y_{PK}} = W_{LK} \tag{18}$$

By inserting the equations (17) and (18) into the equation (16) the following equation is obtained.

$$Z_{PK} = \sum_L U_{PL} \cdot W_{LK} \tag{19}$$

Based on this equation, the repeating operation of designated by R3 in FIG. 4 changes the value of subscript L from 1 to $L_{max}$. Then the product $U_{PL} \cdot W_{LK}$ is repeatedly calculated from the value $U_{PL}$ and $W_{LK}$ obtained in S2 and S4 in FIG. 4 and thus the value $Z_{PK}$ of the above sigmoid is calculated.

The following process S5 to S8 and the repeating process R4 and R5 is the same as the process S1 to S4 for output layer $S_O$ and repetition processes R1 and R2. Namely, above processes in S7 and S8 are repeated as shown by R4 by changing value of the letter J from 1 to $J_{max}$. Then, weight $W_{K1}$ to $W_{KJmax}$. corresponding to all the units of $J_{max}$ number in input layer $S_I$ in K-th unit in hidden layer $S_M$ for p-th pattern is updated. Further the processes in S5 to S8 including a repetition designated by R4 are repeated as shown by R5 by changing the value of the subscript K from 1 to $K_{max}$ and then the weight corresponding to all the units of $J_{max}$ number in input layer $S_I$ in all the unit of $K_{max}$ number in hidden layer $S_M$ with regard to the p-th pattern can be updated. Therefore, a feeding back operation of the error to input layer $S_I$ in all the units in hidden layer $S_M$ in FIG. 3 with regard to p-th pattern is completed.

As is described above, when input and output pattern association unit 210 in FIG. 2 completes a process of updating a weight with regard to one (p-th) learning input and output pattern based on the operational flowchart shown in FIG. 4, new learning input and output pattern is input from the learning input and output pattern pair supplying unit 212 and the same process is repeated. In this case, a player (which may be a maker) stores a plurality of basic learning input and output pattern pair (a pair of an input rhythm pattern calculation information and the corresponding output rhythm pattern calculation information) in learning input and output pattern pair supplying unit 212. The weight may be updated after an error is calculated regarding all the learning input and output patters.

When the process of the updating a weight for all the learning input and output pattern is completed, mode switching unit 211 in FIG. 2 performs a switching operation so that an input rhythm pattern calculation information 207 from input rhythm pattern calculation information producing unit 206 instead of the input from learning input and output pattern pair supplying unit 212 is input to input and output pattern association unit 210.

The operational flowchart of the learning process shown in FIG. 4 can be realized by the execution of the process program stored in ROM in input and output association unit 210 by means of the micro-processor. The neural network formed by input and output pattern association unit 210 comprises a register and an arithmetic operating circuit. This network can be realized by an analog neural network.

Next, the concrete number of the unit of the neural network formed in input and output pattern association unit 210, data structure of input rhythm pattern calculation information 207 and output rhythm pattern calculation information 213 will be explained.

In the embodiment, as an example, the minimum unit within one bar of a sound is represented by the sixteenth note. Furthermore, a rhythm pattern obtained by a combination of five kinds of drum sound, bass drum, snare, low-tom, high-tom and high-hat, is dealt with for respective beats. Namely, the player uses drum pads #1 to #5 of input unit 201 shown in FIG. 2 and enters a rhythm pattern comprising a combination of five kinds of drum sounds and then input and output pattern association unit 210 responds to the rhythm pattern and outputs an output rhythm pattern comprising a combination of five kinds of drum sounds.

The scale of the neural network formed by input and output pattern association unit 210 is that the number of units of input layer $S_I=32$, the number of units of output layer $S_O=32$, and the number of units of hidden layer $S_M=30$.

Figure 5:
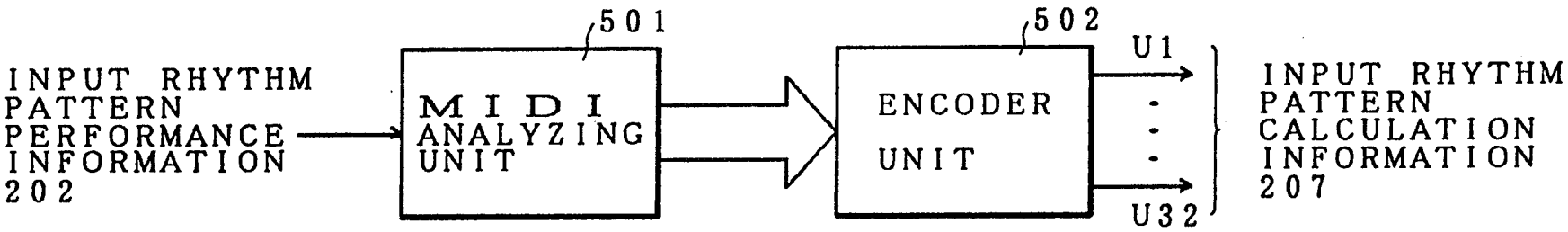
FIG. 5 is a block diagram of the input rhythm pattern calculation information generating unit.

FIG. 5 shows input rhythm pattern calculation information generating unit 206 shown in FIG. 2. In FIG. 5, MIDI analyzing unit 501 analyzes input rhythm pattern performance information 202 output from drum pads #1 to #5 of input unit 201 at respective beats within one bar and simultaneously outputs the input drum sound information to encoder unit 502. Encoder unit 502 compresses information corresponding to three kinds of drum sounds, snare, low-tom and high -tom, thereby outputting it as input rhythm pattern calculation information 207. It compresses information corresponding to two kinds of drum sounds, high-hat and bass drum, and outputs it as the second block of input rhythm pattern calculation information 207. Namely, encoder unit 502 outputs two blocks of calculation information 207 simultaneously at respective beats. In this case, encoder unit 502 inputs the value of the first block of calculation information 207 into the corresponding unit to out of the former 16 units of the input layer $S_I$ in the neural network and similarly inputs the second calculation information 207 the corresponding unit out of the latter half 16 units of input layer $S_I$.

Figure 6:
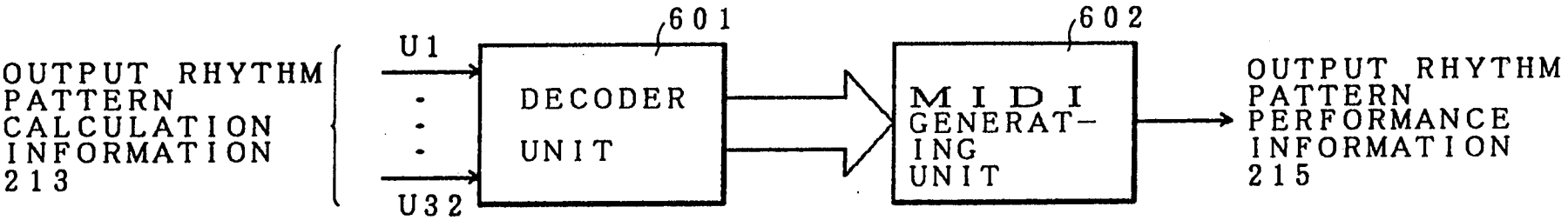
FIG. 6 is a block diagram of the output rhythm pattern performance information generating unit.

In response to the above operation, one unit among 16 former-half units of the output layer S0 outputs the first block of output rhythm pattern calculation information 213 and one of the latter 16 units outputs the second block of output rhythm pattern calculation information 213. These two blocks of calculation information 213 are input to output rhythm pattern performance information generating unit 214. The structure of output rhythm pattern performance information generating unit 214 is shown in FIG. 6. In FIG. 6, decoder unit 601 resolves the first block of output rhythm pattern calculation information 213 and outputs it as information corresponding to three kinds of drum sounds, snare, low-tom and high-tom, to MIDI generating unit 602. Decoder unit 601 resolves the second output rhythm pattern calculation unit 213 and outputs information corresponding to two kinds of drum sounds, high-hat and bass drum, to MIDI generating unit 602. MIDI generating unit 602 produces an MIDI signal corresponding to the above five kinds of information and outputs them as output rhythm pattern performance information 215 in a serial manner, thereby producing the performance information of the response rhythm pattern.

Figure 7:
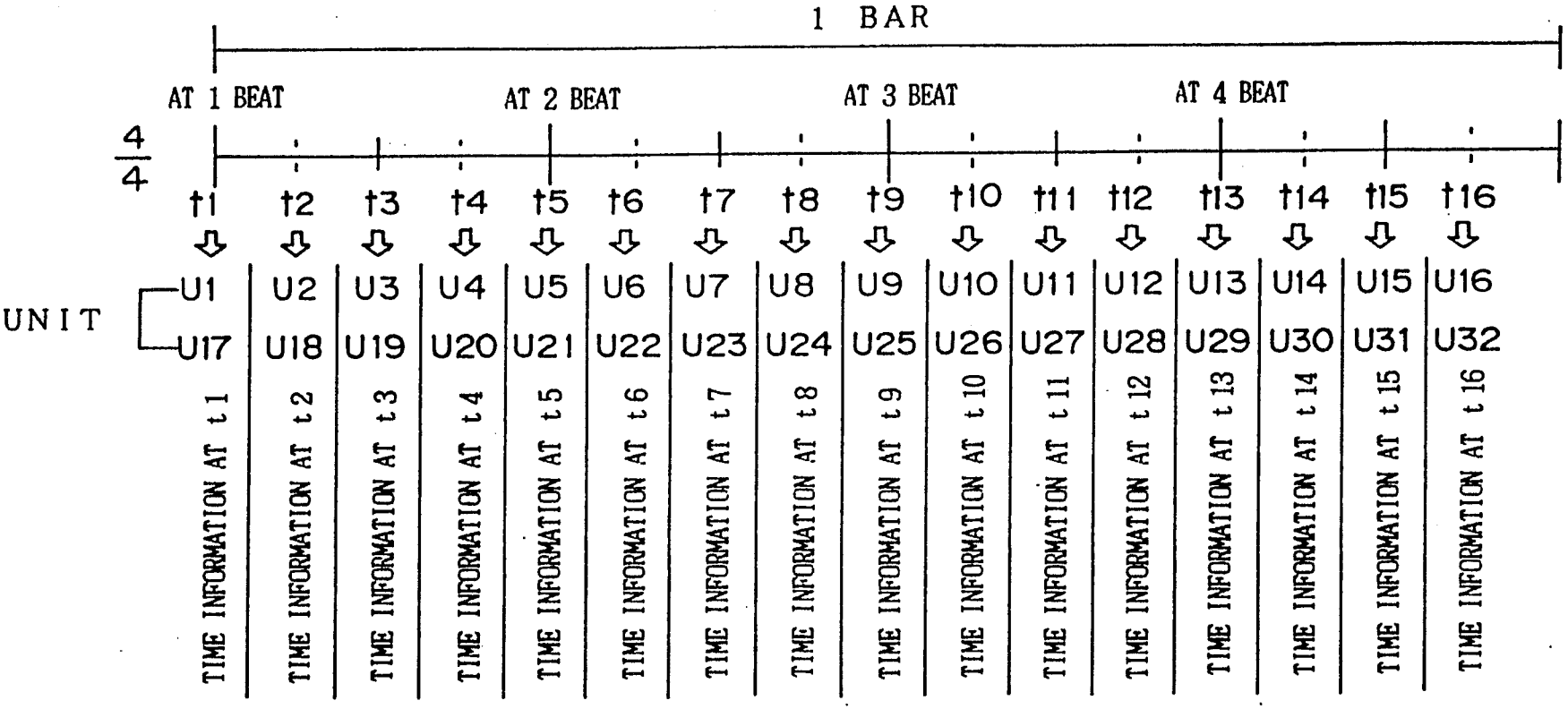
FIG. 7 shows a relation between respective units of the input layer or the output layer in a neural network and a beat.

FIG. 7 shows the relation between note timing, and input layer $S_I$ or output layer $S_O$ (as shown in FIG. 3) of the neural network. When the music has 4/4 times in units of 16th notes and then the output and output timing of the performance information (calculation information) within one bar comprising 16 timings of t1 to t16 as shown in FIG. 7. The first block of input rhythm pattern calculation information 207 or the first block of output rhythm pattern calculation information 213 corresponding to three kinds of drum sounds, snare, low-tom and high-tom, are input to or output from one of the former 16 units, U1 to U16 in the input layer $S_I$ or output layer $S_O$ at respective timings t1 to t16 (as shown in FIG. 3). The second block of input rhythm pattern calculation information 207 or the second block of output rhythm pattern calculation information 213 corresponding to two kinds of drum sounds, high-hat or bass drum, are input to or output from one of the latter 16 units U17 to U32 in the input layer $S_I$ or output layer $S_O$ at respective timings t1 to t16. In FIG. 7, respective calculation information is shown as time information.

Figure 8A:
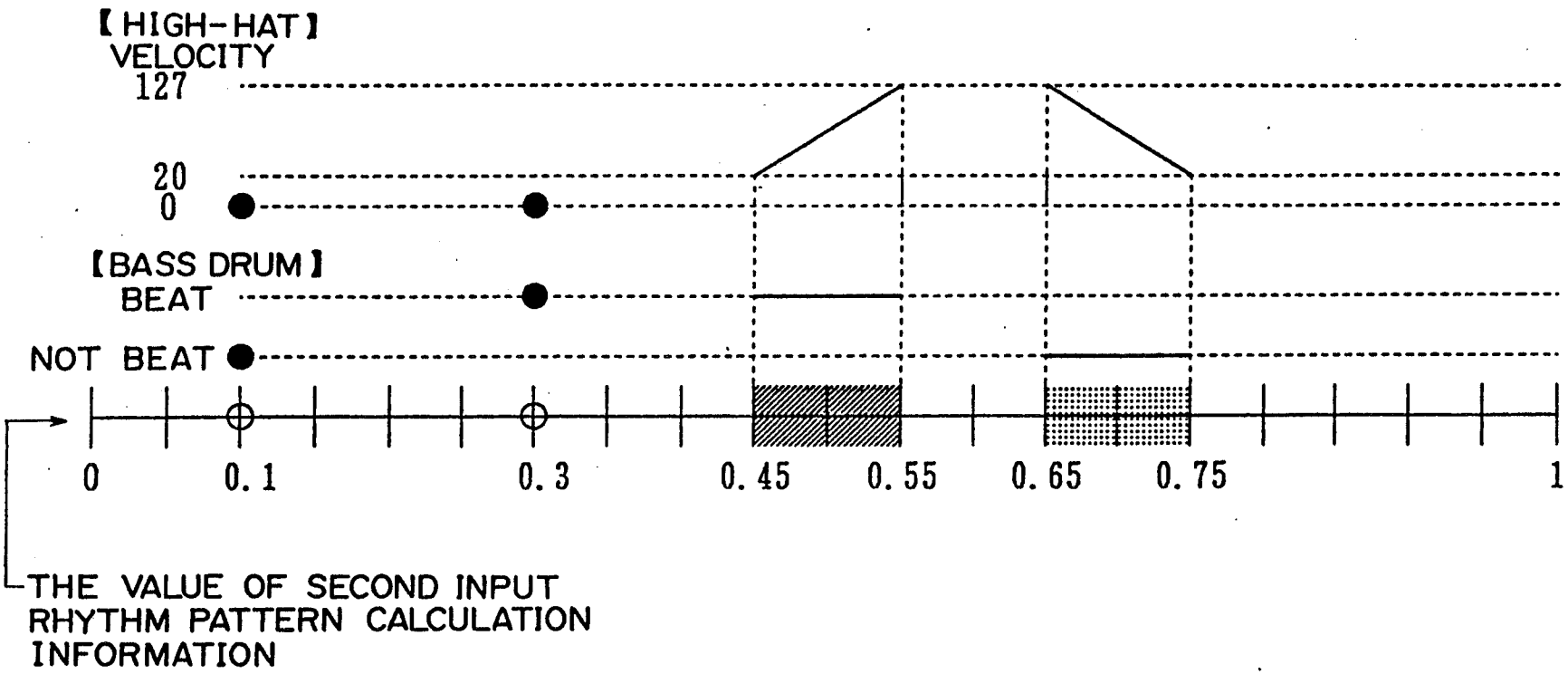
FIGS. 8A and 8B show a relation between the value of the input rhythm pattern calculation data and the input state of the input rhythm pattern performance data with regard to a beat.

Next, FIG. 8A shows the relation between the value of the second block of input rhythm pattern calculation information 207 corresponding to two kinds of drum sounds, high-hat and bass drum, and the input state of input rhythm pattern performance information 202 is shown at one note timing. Where any drum pad corresponding to high-hat or bass drum is not beaten by the player and the corresponding input rhythm pattern performance information 202 is not input to MIDI analyzing unit 501 shown in FIG. 5, encoder unit 502 shown in FIG. 5 outputs the value 0.1 as the second input rhythm pattern calculation unit 207. Where the drum pad corresponding to the bass drum is beaten, the corresponding input rhythm pattern performance information 202 is input, and the drum pad corresponding to the high-hat is not beaten, the value 0.3 is output as the second input rhythm pattern calculation information 207. Further, where the drum pad corresponding to the bass drum is beaten and the corresponding input rhythm pattern performance information 202 is input, the drum pad corresponding to the high-hat is beaten and input rhythm pattern performance information 202 having a velocity value between 20 and 127 corresponding to the strength of the beating operation of the drum pad is input, and a value between 0.45 and 0.55 corresponding to the velocity value is output as the second input rhythm pattern calculation information 207. Then, where the drum pad corresponding to the bass drum is not beaten, the drum pad corresponding to the high-hat is beaten and the input rhythm pattern performance information 202 having a velocity value between 127 and 20 corresponding to the strength of the beaten drum is input, and a value between 0.65 and 0.75 corresponding to the value of the velocity as the second block of input rhythm pattern calculation information 207.

Figure 8B:
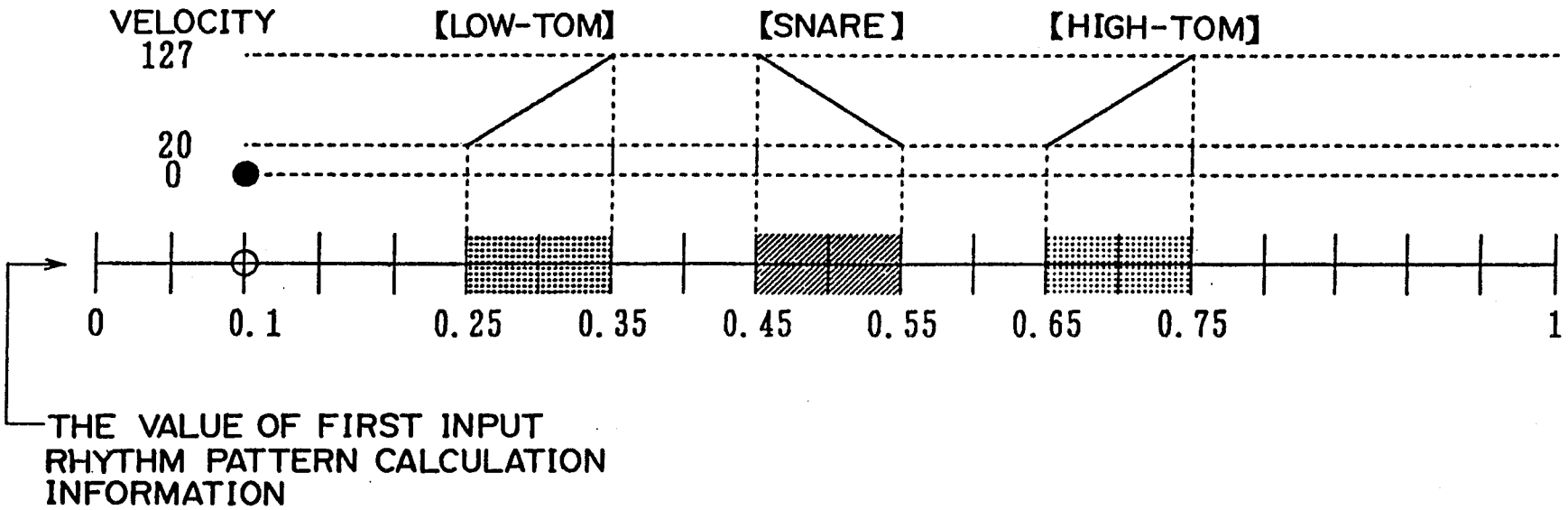

FIG. 8B shows the relation between the value of the first block of input rhythm pattern calculation information 207 corresponding to three kinds of drum sounds, snare, low-tom and high-tom, and the input state of input rhythm pattern performance information 202 is shown for one beat. Where, no drum pad corresponding to snare, low-tom or high-tom is not beaten by a player in input unit 201, the corresponding input rhythm pattern performance information 202 is not input to MIDI analyzing unit 501 shown in FIG. 5. Encoder 502 of FIG. 5 outputs the value of 0.1 as first input rhythm pattern calculation information 207. Where, only the drum pad corresponding to the low-tom out of three kinds of drum pads is beaten and input rhythm pattern performance information 202 having a velocity value between 20 and 127 corresponding to the beaten strength of the drum, a value between 0.25 and 0.35 corresponding to the value of the above velocity is output as the first input rhythm pattern calculation information 207. Further, where only the drum pad corresponding to the snare is beaten and the input rhythm pattern performance information 202 having a velocity value between 127 and 20 corresponding to the beaten strength, the value between 0.45 and 0.55 corresponding to the above velocity value is output as the first input rhythm pattern calculation information 207. Where only the drum pad corresponding to high-tom is beaten and the input rhythm pattern performance information 202 having a velocity value between 20 and 127 corresponding to the beaten strength, a value between 0.65 and 0.75 corresponding to the velocity value is output as the first block of input rhythm pattern calculation information 207.

Figure 9A:
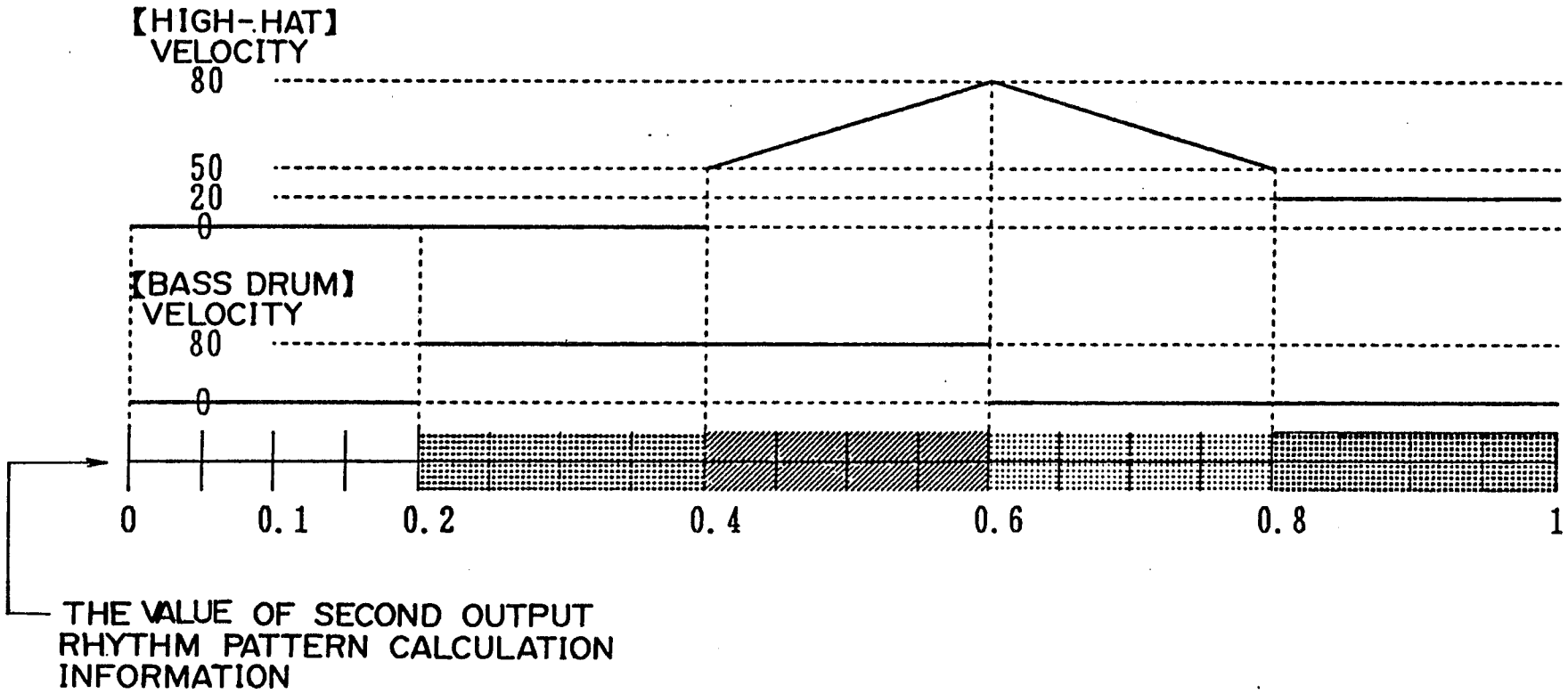
FIGS. 9A and 9B show a relation between the value of the output rhythm pattern calculation data and the output state of the output rhythm pattern performance data with regard to a beat.

FIG. 9A shows a relation between the value of the second block of output rhythm pattern calculation information 213 output from neural network U17 to U32 of input and output pattern association unit 210 after the learning process by the back propagation is completed and the output state of output rhythm pattern performance information 215 corresponding to two kinds of drum sounds, high-hat and bass drum, produced based on the second block of output rhythm pattern calculation information 213.

Where the value of the second output rhythm pattern calculation information 213 input to decoder unit 601 shown in FIG. 6 is less than 0.2, output rhythm pattern performance information 215 corresponding to either high-hat or bass drum is not output from MIDI generating unit 602. Where the value of the input second output rhythm pattern calculation information 213 is more than 0.2 and less than 0.4, output rhythm pattern performance information 215 corresponding to the bass drum is output and output rhythm pattern performance information corresponding to the high-hat is not produced. Where the value of the second block of output rhythm pattern calculation information 213 is more than 0.4 and less than 0.6, output rhythm pattern performance information 215 having a velocity value of 80 corresponding to the state in which the bass drum is beaten and the output rhythm pattern performance information 215 having a velocity value between 50 and 80 corresponding to the value of the above calculation information are output. Further, where the value of the input of the second block of output rhythm pattern calculation information 213 is more than 0.6 and less than 0.8, corresponding to the state in which high-hat is beaten and the output rhythm pattern performance information 215 having a velocity value between 80 and 50 corresponding to the value of the above calculation information is output and the output rhythm pattern performance information corresponding to the bass drum is not output. Where the value of the input second output rhythm pattern calculation information 213 is more than 0.8, the output rhythm pattern performance information 215 of the value 20 of the velocity corresponding to the state in which the high-hat is beaten is output and the output rhythm pattern performance information 215 corresponding to the bass drum is not output.

Figure 9B:
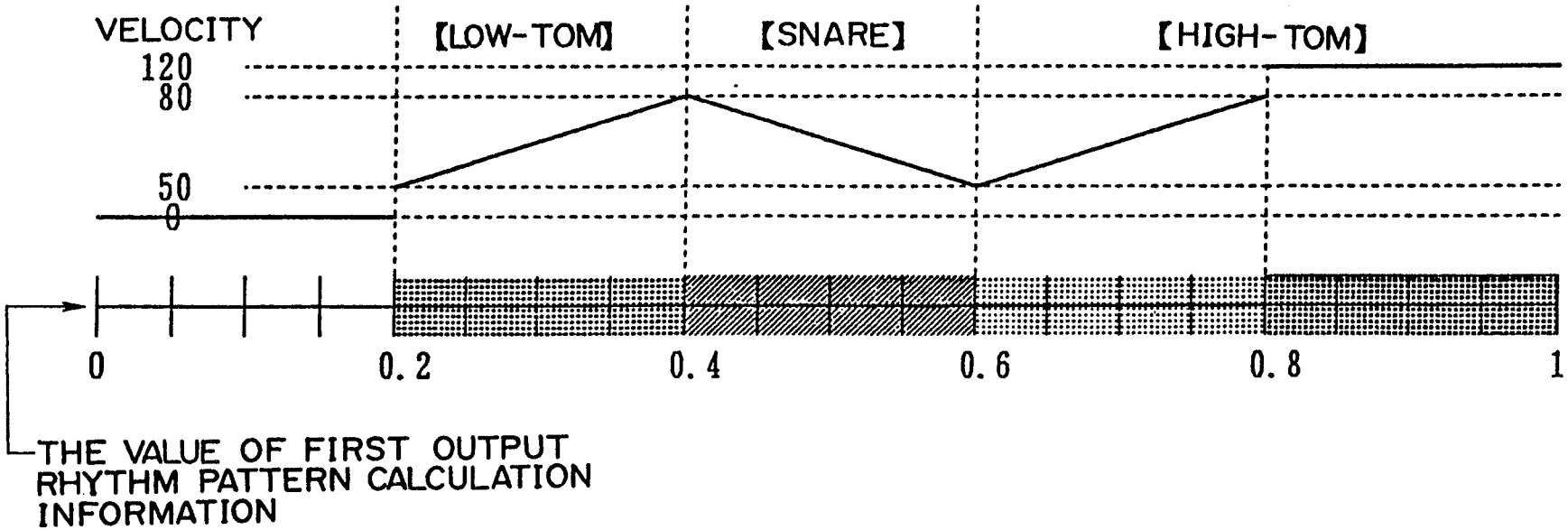

FIG. 9B shows the relation between the value of the second block of output rhythm pattern calculation information 213 output from a unit of a neural network U1 to U16 in input and output pattern association unit 210 after the learning process by the back propagation is completed and the output state of output rhythm pattern performance information 215 corresponding to the three kinds of drum sounds, low-tom, snare and high-tom, is shown. Where the value of the first output rhythm pattern calculation information 213 input to the decoder unit 601 of FIG. 6 is less than 0.2, MIDI generating unit 602 does not output output rhythm pattern performance information 215 corresponding to any one of the above three kinds. Where the value of the input first output rhythm pattern calculation information 213 is more than 0.2 and less than 0.4, it corresponds to a state in which the low -tom is beaten and output rhythm pattern performance information 215 having a velocity value between 50 and 80 corresponding to the value of the above calculation information is output. Where the value of the input first output rhythm pattern calculation information 213 is more than 0.4 and less than 0.6, it corresponds to the state in which the snare is beaten and the output rhythm pattern performance information 215 having a velocity value between 80 and 50 corresponding to the value of the above calculation information is output. Further, where the value of the first output rhythm pattern calculation information 213 is more than 0.6 and less than 0.8, it corresponds to the state in which the high-tom is beaten and the output rhythm pattern performance information 215 having a velocity value between 50 and 80 corresponding to the value of the above calculation information is output. Where the value of input first output rhythm pattern calculation information 213 is more than 0.8, it corresponds to the state in which the high-tom is beaten and the output rhythm pattern performance information 215 having a velocity value of 120 is output.

In this manner, a rhythm pattern comprising a combination of five kinds of drum sounds using the drum pads (as shown in FIG. 2) #1 to #5 of input unit 201 is input at a respective note timing by a player, and the corresponding drum sound is produced from sound source 203. Then, in response to this situation, output rhythm pattern performance information 215 can be obtained from input and output pattern association unit 210 and a drum sound comprising a combination of the corresponding five kinds of drum sounds is produced at sound source 216. Therefore, the drum sound based on the performance operation by the player is produced from speaker 205 and the drum sound used for a "session" is produced from speaker 218.

By using the data format shown in FIG. 7 to FIG. 9B, information concerning the rhythm pattern is dealt with and then on/off information representing "beaten/not beaten" of many kinds of drums and velocity information concerning the strength with which the drum is beaten can be dealt with at the minimum number of the unit.

Upon learning the process, the player determines a basic combination of input rhythm pattern calculation information 207 and output rhythm pattern calculation information 213 at the learning input and output pattern pair supplying unit 212 of FIG. 2 and the learning process can be carried out in input and output pattern association unit 210 based on the combination by means of a back propagation. It is not necessary to determine all the combinations by causing the value of input rhythm pattern calculation information 207 shown in FIGS. 8A and 8B to correspond exactly to the output value of rhythm pattern calculation information 213 shown in FIGS. 9A and 9B. When even if the player inputs input rhythm pattern calculation information 207 having a value other than the basic value previously determined by the learning input and output pattern pair supplying unit after the completion of the learning process 212, the output rhythm pattern calculation information 213 as shown in FIGS. 9A and 9B, which has an hidden value other than the basic value corresponding to the input rhythm pattern calculation information 207, can be obtained. In other words, if the player forms a rhythm pattern at the basic rhythm pattern, a rhythm pattern which can respond to such a rhythm pattern and can perform "cession" can be produced.

In the first preferred embodiment, the minimum partition of one bar is the 16th note as shown in FIG. 7, but is not limited to this note. The present invention may be applied to various kinds of beats.

In the first preferred embodiment, one session of drum sound can be realized as a combination of the input rhythm pattern of 1 bar and the output rhythm pattern of 1 bar, but greater numbers of bars may be used as a matter of course.

In the first preferred embodiment, the number of kinds of drum sounds to be dealt with in the rhythm pattern is five at maximum and the kinds of drum sound which can be beaten simultaneously is high-hat, bass drum and one of low-tom, snare and high-tom, making a total of three kinds. As a matter of course the present invention is not limited to the above combination. Further, it is possible to provide the velocity for respective kinds of drum sounds, but it can be provided by other methods than recited in the first embodiment.

In the first preferred embodiment, sound source 203 of input rhythm pattern, amplifier 204 and speaker 205, sound source unit 216 for the output rhythm pattern, amplifier 217 and speaker 218 are structured separately and as a matter of course they may be used as a common structure.

Second Preferred Embodiment

Figure 10:
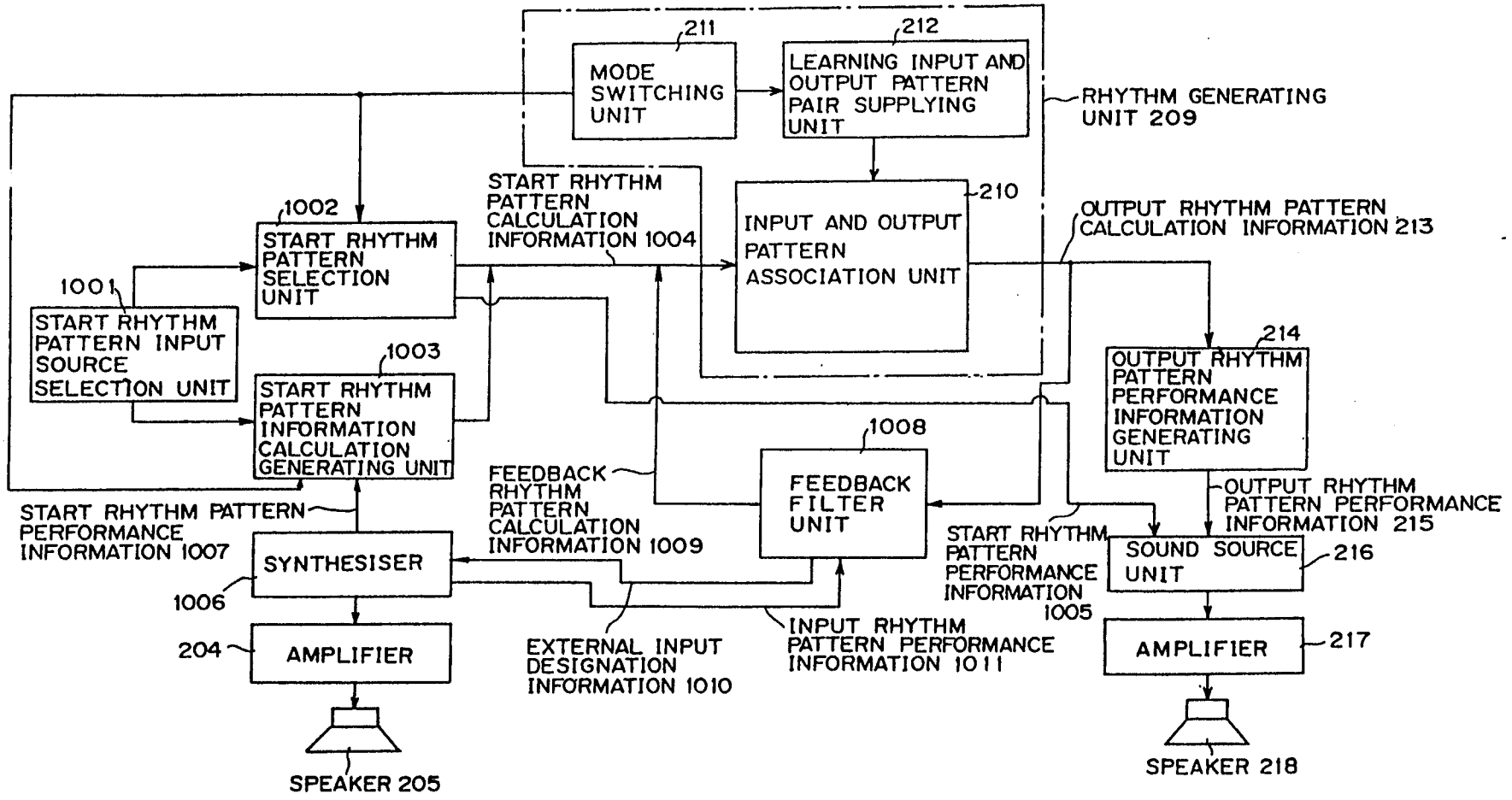
FIG. 10 shows a block diagram of the second preferred embodiment of the present invention.

Next, FIG. 10 shows the second preferred embodiment of the present invention.

The second preferred embodiment can produce the information of the rhythm pattern in response to the input rhythm pattern information at input and output pattern association unit 210 in rhythm generating unit 209. In addition, in the second preferred embodiment, output rhythm pattern calculation information 213 output from rhythm generating unit 209 is modified by feed-back filter unit 1008 and the modified feed-back rhythm pattern calculation information 1009 is fed back to rhythm generating unit 209, thereby automatically producing a rhythm pattern train.

The same part as in the first preferred embodiment in FIG. 2 is provided with the same reference number and performs the same function.

Next, first rhythm pattern calculation information to input and output pattern association unit 210 of rhythm generating unit 209 is provided by start rhythm pattern selection unit 1002 or start rhythm pattern calculation information generating unit 1003 as start rhythm pattern calculation information 1004. In this case, the player can select "selection" or "generation" of the start rhythm pattern by start rhythm pattern input source selection unit 1001. A player selects "selection" where the start rhythm pattern is formed by selecting one of the previously prepared plurality of start rhythm patterns and selects "generation" where an MIDI musical instrument such as a synthesizer or keyboard and mouse of a personal computer (in FIG. 10, synthesizer 1006 is used) performs a rhythm pattern which is desired to be a start rhythm pattern and inputs them.

Figure 11:
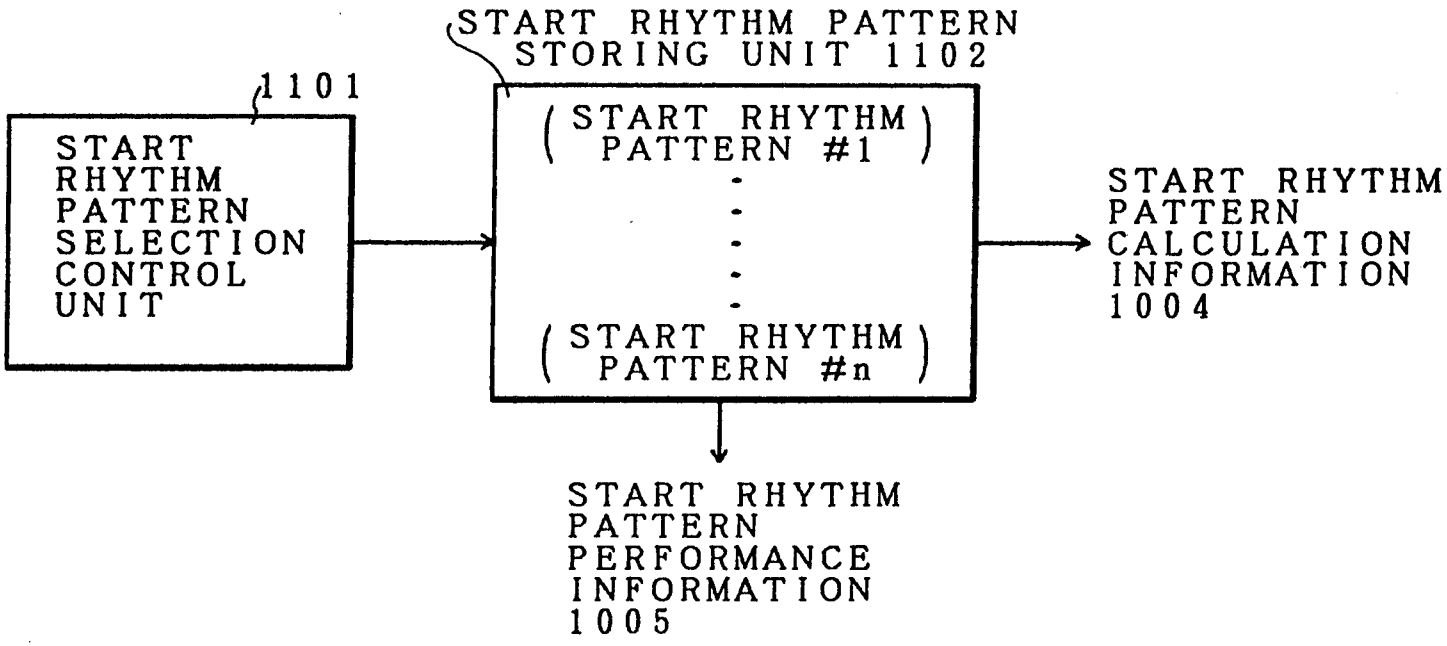
FIG. 11 shows a block diagram of a start rhythm pattern selection unit.

When the player designates "selection", start rhythm pattern selection unit 1002 is activated. FIG. 11 shows a flowchart of start rhythm pattern selection unit 1002. A plurality of start rhythm patterns (#1 to #n) are stored in the start rhythm pattern storing unit 1102. The player may previously memorize the start rhythm pattern. The player selects one of the start rhythm patterns previously stored in start rhythm pattern storing unit 1102 by start rhythm pattern selection control unit 1101 and when the player designates the start rhythm pattern selection unit 1002 by start rhythm pattern input source selection unit 1001 when the rhythm pattern train is subject to automatic performance, a reading operation starts by reading the previously selected start rhythm pattern from start rhythm pattern storing unit 1102. In this case, the start rhythm pattern comprises start rhythm pattern performance information 1005 and start rhythm pattern calculation information 1004. The start rhythm pattern performance information 1005 is transmitted to sound source unit 216 and the rhythm sound corresponding to the start rhythm pattern is produced from speaker 218 through amplifier 217. The start rhythm pattern may be formed at the side of the synthesizer 1006. The start rhythm pattern calculation information 1004 is input to the input and output pattern association unit 210 in rhythm generating unit 209 as the first rhythm pattern of the automatic performance of the rhythm pattern train. Start rhythm pattern selection unit 1002 only memorizes start rhythm pattern calculation information 1004 and may produce start rhythm pattern performance information 1005 based on the start rhythm pattern calculation information 1004.

When the player designates "generation", start rhythm pattern calculation information generating unit 1003 is activated. In this case, the player performs a start rhythm pattern with a discretional length by using synthesizer 1006. The start rhythm pattern may be a rhythm pattern such as a count sound of a drum or may be part of a melody pattern. When synthesizer 1006 is replaced by a personal computer, the start rhythm pattern may be the numerical value data input from the keyboard of the personal computer. The rhythm sound corresponding to the start rhythm pattern is produced by synthesizer 1006 by the above performance operation. The rhythm sound is produced by speaker 205 through amplifier 204 and start rhythm pattern performance information 1007 corresponding to MIDI standard is output from synthesizer 1006. The start rhythm pattern performance information 1005 is converted to start rhythm pattern calculation information 1004 at start rhythm pattern calculation information generating unit 1003. Start rhythm pattern calculation information 1004 is input to input and output pattern association unit 210 in rhythm generating unit 209 as the initial rhythm pattern of the automatic performance of the rhythm pattern train. Start rhythm pattern calculation information generating unit 1003 has the same structure as the input rhythm pattern calculation information generating unit 206 in the first preferred embodiment shown in FIG. 2.

Input and output pattern association unit 210 in rhythm generating unit 209 performs the same process as that which the rhythm generating unit 209 in FIG. 2 applies to input rhythm pattern calculation unit 207 and starts the generation of output rhythm pattern calculation information 213 in response to start rhythm pattern calculation information 1004. In this case start rhythm pattern calculation information 1004 has the same data format as the input rhythm pattern calculation information 207 in FIG. 2 and the output rhythm pattern calculation information 213 has the same data format as in FIG. 2.

Feedback filter 1008 is the most characteristic feature of the present embodiment. Feedback filter 1008 modifies output rhythm pattern calculation information 213 outputted by rhythm generating unit 209 to feedback rhythm pattern calculation information 1009 and feeds it back to rhythm generating unit 209.

Figure 12:
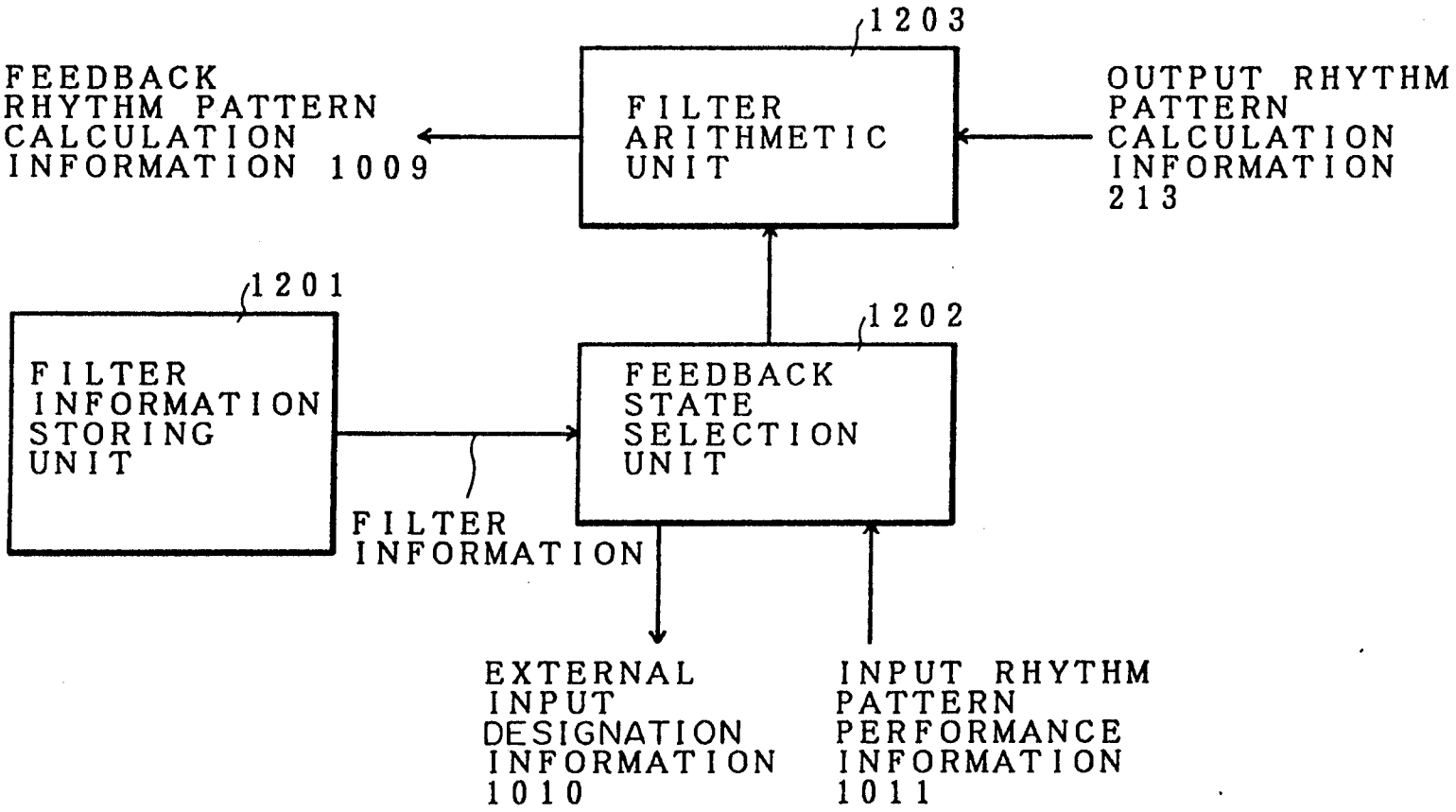
FIG. 12 shows a view of a feedback filter unit.

FIG. 12 shows the structure of feedback filter unit 1008. Feedback state selection unit 1202 can select the feedback state in accordance with "fill-in", "ending", "fade out", "pass without any condition (through)", "external input" or other feedback states in accordance with the predetermined rules. The filter information for generating a rhythm pattern such as "fill-in", "ending" or "fade out" in filter information is stored in storing unit 1201.

Where a feedback state such as "fill-in", "ending" or "fade out" is selected in feedback state selection unit 1202, the corresponding filter information is read out from filter information storing unit 1201 and is provided in filter operation unit 1203. Filter arithmetic operating unit 1203 performs and operates based on the above filter information with regard to output rhythm pattern calculation information 213 output from rhythm generating unit 209 and the operational result is fed back to rhythm generating unit 209 as feedback rhythm pattern calculation information 1009. Therefore, rhythm generating unit 209 automatically produces the rhythm pattern train corresponding to "fill -in", "ending" or "fade out" as the output train of output rhythm pattern calculation information 213.

On the other hand, where the feedback state of "external input" is selected by feedback state selection unit 1202, feedback state selection unit 1202 outputs external input designation information 1010 to synthesizer 1006. Therefore, synthesizer 1006 supplies input rhythm pattern performance information 1011 to feedback state selection unit 1202. This information is based on the MIDI standard corresponding to the performance operation of the player of synthesizer 1006. Filter state selection unit 1202 performs a conversion of input rhythm pattern performance information 202. Filter arithmetic operation 1203 performs an operation of output rhythm pattern calculation information 213 based on the above result of the conversion and the result of the arithmetic operation is fed back to rhythm generating unit 209 as feedback rhythm pattern calculation information 1009. In response to the performance operation of synthesizer 1006 by the player, the rhythm pattern train automatically produced from rhythm generating unit 209 can thereby be varied. For example, feedback state selection unit 1202 recognizes that the player repeats the predetermined performance pattern in synthesizer 1006 and feedback base selection 1202 controls filter information storing unit 1201 and filter operation unit 1203 so that the rhythm pattern train by output pattern calculation information 213 corresponds to "fill-in", "ending" or "fade out". This control makes it possible to automatically produce the rhythm pattern train corresponding to the operation of the player at synthesizer 1006 in a real time manner and being matched with the sensitivity of the human to be automatically produced as the output train of output rhythm pattern calculation information 213.

Where feedback state of "pass without condition (through)" is selected in feedback state selection unit 1202, feedback state selection unit 1202 outputs the output rhythm pattern calculation information 213 to filter arithmetic operation unit 1203 as feedback rhythm pattern calculation information 1009. Therefore, the rhythm generating unit 209 is operated by the value of the previous output rhythm pattern calculation information 213, thereby generating the output rhythm pattern train.

The output train of automatically produced output rhythm pattern calculation information 213 is converted to corresponding output rhythm pattern performance information 215 in output rhythm pattern performance generating unit 214 in the manner shown in FIG. 2 for the first embodiment.

Sound source 216 forms the rhythm sound train corresponding to the above performance information 215. The rhythm sound train is produced from speaker 218 through amplifier 217.

Figure 13:
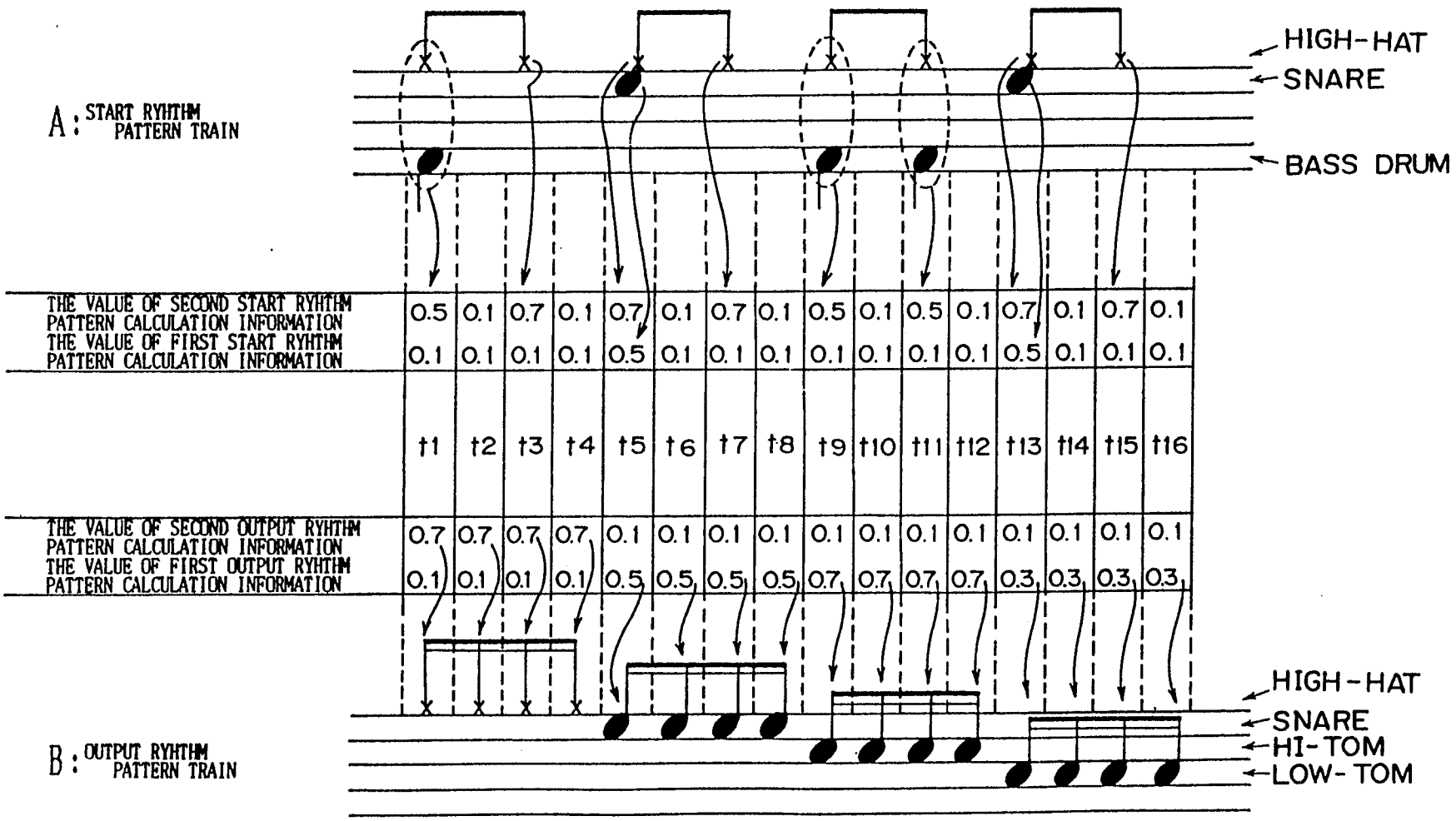
FIG. 13 shows an operation of the second embodiment.

FIG. 13 shows an operational example of the second preferred embodiment. Provided that the start rhythm pattern train as shown in A in FIG. 13 is provided as the start rhythm pattern calculation information 1004 of FIG. 10, the drum sound of high-hat and bass drum is compressed to the second start rhythm pattern calculation information 1004 with the same data format as that shown in FIG. 8A in the first embodiment. A drum sound such as low-tom, snare or high-tom is compressed to first start rhythm pattern calculation information 1004 of the same data format as in FIG. 8B. The rhythm generating unit 209 and feedback filter 1008 in FIG. 10 operates effectively for the start rhythm pattern train. Then the output rhythm pattern train shown in B in FIG. 13 is automatically obtained as the output rhythm pattern calculation information 213 of FIG. 10 and is repeated in the following bar of the music. In this case, the sound of a drum such as a high-hat or bass drum is compressed to the second output rhythm pattern calculation information 213 with the same data format as in the first preferred embodiment, shown in FIG. 9A. The drum sound of low-tom, snare and high-tom is compressed to the first output rhythm pattern calculation information 213 with the same data format as is shown in FIG. 9B in the first embodiment.

As explained above, the second preferred embodiment utilizes rhythm generating unit 209 for generating the appropriate rhythm pattern in response to the input rhythm pattern as used in the first embodiment and feeds back the output rhythm pattern calculation information 213 to rhythm generating unit 209 as feedback rhythm pattern calculation information 1009, thereby automatically generating the appropriate rhythm pattern train. At this time, output rhythm pattern calculation information 213 is modified by feedback filter unit 1008 and the intention of the player can be properly reflected on the automatic production operation.

In the second embodiment the neural network is used for the input and output pattern association unit 210 in FIG. 10 in the same manner as in the first embodiment. The input and output pattern association unit 210 may be formed of any type of unit in which the information of the rhythm pattern which responds appropriately to the input rhythm pattern information is outputted.

As described above, according to the present invention, the input and output pattern association unit for receiving more than one block of input information representing a state of the sound production of musical sound as an input pattern and for outputting the output pattern in response to the input pattern as more than one block of output information representing the state of the sound production of the musical sound can output an output pattern other than the basic pattern so that the output pattern responds well to an input pattern other than the pattern which is used for learning, when the learning process is completed.

Further, as an input calculation information generating unit and an output performance information generating unit are provided, the input performance information representing on/off or a velocity of many kinds of the musical instrument sounds based on the performance operation can be compressed with high efficiency.

In addition to the above input and output pattern association unit, the present invention provides a start information supplying means and a feedback means for feeding back the output information to the input side of the input and output pattern association unit as the input information with or without modification, thereby automatically outputting the output pattern train.

What is claimed is:

1. A rhythm pattern generating apparatus for outputting an output pattern designating a performance operation state in response to an input pattern designating the performance operation state, comprising:

input means for inputting an input pattern, input and output pattern association means for performing a learning process by forming an association between said input pattern and said output pattern so that the output pattern that is desired by the player can be produced in response to said input pattern, and output means for outputting the output pattern and output information blocks designating a state of production of a musical sound in response to input information blocks designating the state of the production of the musical sound.

2. A rhythm pattern generating apparatus for outputting an output pattern designating a performance operation state in response to an input pattern designating the performance operation state, comprising:

input calculation information generating means for receiving input performance information blocks designating a production state of a musical sound, for compressing the input performance information blocks and for generating input calculation information at respective performance timings, input and output pattern association means for performing a learning process by forming an association between the input pattern and the output pattern so that the output pattern that is desired by a player can be produced in response to the input pattern and for receiving the input calculation information as the input pattern and for outputting the output pattern in response to the input pattern as output calculation information at respective performance timings, and output performance information generating means for generating output performance information blocks designating the production state of the musical sound in response to the output calculation information.

3. The rhythm pattern generating apparatus according to claim 2, wherein said input and output pattern association means comprises:

a layered network comprising an input layer comprising a plurality of units for receiving information forming the input pattern, an output layer comprising a plurality of units for outputting each block of information forming the output pattern, and at least one hidden layer connected between said input layer and said output layer and comprising a plurality of units, and weight adjusting means for adjusting weights between said units to form the association between the input pattern and the output pattern so that when the input pattern is input to said input layer, the output pattern desired by a player of the rhythm pattern generating apparatus is output from the output layer in response to the input pattern.

4. The rhythm pattern generating apparatus according to claim 3, wherein said weight adjusting means comprises means for determining the weights by a back propagation method and wherein said input and output pattern association means comprises means for providing a pair of patterns comprising a learning input pattern and an output pattern to said layered network so that the input pattern is input to said input layer and the output pattern desired by the player is output from said output layer in response to the input pattern.

5. The rhythm pattern generating apparatus according to claim 4, comprising:

mode selecting means for switching said input and output pattern association means to one of a learning mode and a rhythm pattern output mode, and learning input and output pattern pair supply means for supplying the pair of patterns to said input and output pattern association means when said mode selecting means switches said input and output pattern association means to the learning mode.

6. The rhythm pattern generating apparatus according to claim 2, wherein said input calculation information generating means comprises means for receiving the input performance information blocks designating production and silence of a plurality of predetermined kinds of musical sounds and for converting the input performance information blocks in accordance with a predetermined rule for every one of the predetermined kinds of musical sounds to produce multi-valued data representing the input calculation information by at least one real number value, wherein said input and output pattern association means comprises means for outputting, at respective performance timings, multi-valued data representing the output calculation information by at least one real number value, and wherein said output performance information generating means comprises means for converting the multi-valued data in accordance with a predetermined rule at respective performance timings to produce the output performance information blocks designating production and silence of the plurality of predetermined kinds of musical sounds.

7. The rhythm pattern generating apparatus according to claim 2, wherein said input calculation information generating means value as said input calculation information by converting more comprises means for receiving the input performance information blocks designating production, silence and velocity of a plurality of predetermined kinds of musical sounds at respective performance timings and for converting the input performance information blocks in accordance with a predetermined rule, wherein said input and output pattern association means comprises means for outputting, at respective performance timings, multi-valued data representing the output calculation information by at least one real number value, and wherein said output performance information generating means comprises means for converting the multi-valued data in accordance with a predetermined rule to produce the output performance information blocks designating production, silence and velocity of the plurality of predetermined kinds of musical sounds.

8. The rhythm pattern generating apparatus according to claim 2, wherein the input performance information blocks and the output performance information blocks comprise musical instrument digital interface signals.

9. The rhythm pattern generating apparatus according to claim 2, further comprising drum pads operatively coupleable to said input calculation information generating means to provide rhythm pattern performance information in the input performance information blocks.

10. The rhythm pattern generating apparatus according to claim 9, further comprising switch control means for gating said input calculation information to said input and output pattern association means by using at least one of said drum pads.

11. A rhythm pattern generating apparatus for automatically outputting an output pattern designating a performance operation state, comprising:

input and output pattern association means for performing a learning process by forming an association between an input pattern and the output pattern so that the output pattern desired by a player can be produced, for receiving input calculation information as the input pattern designating a production state of generation of a musical sound and for correspondingly outputting the output pattern as more than one output calculation information representing a production state of the musical sound, start information supplying means for supplying a start pattern to said input and output pattern association means as a block of start information, and feedback means for feeding back by coupling the output information from said input and output pattern association means to said input and output pattern association means as the input information.

12. The rhythm pattern generating apparatus according to claim 11, wherein said start information supplying means comprises:

start information storing means for storing more than one start information, start information selecting means for selecting from the more than one start information, and start information selection control means for enabling selection by the player of a block of start information from said start information storing means.

13. The rhythm pattern generating apparatus according to claim 11, wherein said start information supplying means comprises start information generating means for generating the start pattern based on performance operation of the player.

14. The rhythm pattern generating apparatus according to claim 11, wherein said start information supplying means comprises start information storing means for storing the start information, start information selection means for enabling selection by the player of a block of the start information from said start information storing means, start information generating means for generating the start information based on a performance operation by the player, and start information source selection means for enabling selective activation by a player of one of said start information selection means and said start information generating means.

15. The rhythm pattern generating means according to claim 11, wherein said feedback means includes operation means for performing a modification operation on said output information.

16. The rhythm pattern generating means according to claim 15, wherein said feedback means comprises arithmetic information storing means for storing arithmetic information to control the modification operation of said operation means, and selection means for selecting the arithmetic information from said operation information storing means.

17. The rhythm pattern generating means according to claim 16, wherein said selection means comprises means for controlling said operation means based on performance operation of the player.

18. A rhythm pattern generating apparatus for generating an output pattern signal indicative of a musical sound pattern in response to a performance operation of a player, comprising:

a layered neural network connected to generate the output pattern signal indicative of the musical sound pattern based on both an input pattern signal and a weight signal; and a feedback circuit connected to said layered neural network to feed back the output pattern signal to said layered neural network.

19. An apparatus according to claim 18, further comprising:

a drum pad connected to said layered neural network.

20. An apparatus according to claim 18, further comprising:

an input pattern memory for storing a plurality of predetermined patterns; and an input pattern selector switch selectively connected to said input pattern memory to provide the input pattern signal to said layered neural network.

21. An apparatus according to claim 20, further comprising:

a switch gratingly connected between said input pattern selector and said layered neural network in response to a drum pad.

22. An apparatus according to claim 18, wherein said feedback circuit comprises a modification operation circuit connected to said layered neural network to modify the output pattern signal based on the performance operation.

23. An apparatus according to claim 18, further comprising:

a start information circuit connected to said layered neural network to provide start information for the input pattern signal.

24. An apparatus according to claim 18, further comprising:

a learning mode/rhythm pattern output mode switch connected to said layered neural network.

25. An apparatus according to claim 18, wherein said feedback circuit comprises a back propagation method circuit connected to said layered neural network.

* * * * *

UNITED STATES PATENT AND TRADEMARK OFFICE

CERTIFICATE OF CORRECTION

PATENT NO. : 5,138,928

DATED : August 18, 1992

INVENTOR(S) : Masako Najima, et al

It is certified that error appears in the above-identified patent and that said Letters Patent is hereby corrected as shown below:

Col. 2, line 60, "pattern more" should be --pattern. More--.

Col. 12, line 41, "p th" should be --p-th--.

Col. 25, line 23 (claim 7, line 4), delete "value as said input calculation information";

line 24 (claim 7, line 5), delete "by converting more".

Signed and Sealed this

Twenty-sixth Day of October, 1993

*Attest:*

*Attesting Officer*

BRUCE LEHMAN

*Commissioner of Patents and Trademarks*